US006067778A

United States Patent [19]

Yamamoto et al.

[11] Patent Number: 6,067,778

[45] Date of Patent: May 30, 2000

[54] PACKAGING CONTAINER PRODUCTION EQUIPMENT AND PACKAGING CONTAINER PRODUCTION METHOD

[75] Inventors: Hidekimi Yamamoto; Akimasa Fujimoto; Michio Ueda, all of Itano-gun, Japan

[73] Assignee: Shikoku Kakoki Co., Ltd., Japan

[21] Appl. No.: 09/084,173

[22] Filed: May 26, 1998

[30] Foreign Application Priority Data

May 30, 1997 [JP] Japan ..... 9-141538

[51] Int. Cl.[7] ..... B65B 9/22; B65B 57/04

[52] U.S. Cl. ..... 53/451; 53/51; 53/64; 53/551; 53/389.2; 226/30; 242/417.3; 242/418.1; 493/29; 493/302

[58] Field of Search ..... 53/51, 64, 551, 53/389.2, 451, 389.4; 226/28, 29, 30, 31, 44; 242/417.3, 418.1; 493/23, 29, 302

[56] References Cited

U.S. PATENT DOCUMENTS

| | | | |
|---|---|---|---|
| 2,636,732 | 4/1953 | Howard | 53/551 |
| 3,116,032 | 12/1963 | Roberts | 242/417.3 |
| 3,417,674 | 12/1968 | Abrahamson | 53/51 |
| 3,787,001 | 1/1974 | Henry | 53/51 |
| 4,033,522 | 7/1977 | Chestnut et al. | 242/418.1 |
| 4,074,504 | 2/1978 | Greenwalt et al. | 53/551 |
| 4,129,238 | 12/1978 | Herd | 226/29 |
| 4,262,474 | 4/1981 | Reuter et al. | 53/551 |
| 4,566,253 | 1/1986 | Jones | 53/551 |
| 5,317,858 | 6/1994 | Hanai | 53/551 |
| 5,480,085 | 1/1996 | Smithe | 242/418.1 |

*Primary Examiner*—John Sipos
*Attorney, Agent, or Firm*—Lorusso & Loud

[57] ABSTRACT

A packaging container production method for forming tubular web from sheet-like web and producing hexahedral packaging containers, wherein in order to secure a prescribed web W feeding amount, the operating amount of lug folding flaps, which forms a sealing part on tubular web by pressing both sides of the tubular web while folding the same, is set an idealistic position, pressure is generated at a cylinder 16 by a control device 23 via a control valve 31, in compliance with the deviation of the detection mark such as a specified printing pattern on the printing surface on web W from the reference position when the same is detected, and the tension applied onto web W is adjusted by the dancer roller 9.

3 Claims, 11 Drawing Sheets

REFERENCE
0.5mm
1.0mm
1.5mm
① ② ③

REFERENCE
0.5mm
1.0mm
1.5mm

REFERENCE
0.5mm
1.0mm
1.5mm
① ... USUAL FEEDING ACTION
② ... USUAL FEEDING ACTION
③ ... CORRECTIVE FEEDING ACTION

PACKAGING CONTAINER PRODUCTION EQUIPMENT AND PACKAGING CONTAINER PRODUCTION METHOD

TECHNICAL FIELD

The present invention relates to packaging container producing equipment and a packaging container producing method, in particular to packaging container producing equipment and a packaging container producing method of reforming sheet-like web to tubular web and filling said tubular web with contents such as fluid food.

BACKGROUND ART

In packaging container producing equipment for producing packaging containers, into which a content is filled, from sheet-like web, rolled sheet-like web W of rewinder L, which is wound to be roll-like as shown in FIG. 1, is wound back by a windback device, the wound-back sheet-like web W is transferred by web feeding roller 10 and is sent to tube forming device 3 via tension pressing device 2 consisting of a dancer roll (rocking roller) 9, which gives tension to the abovementioned web W at all times, and guide roller 11, wherein the sheet-like web W is reformed to be tubular web W while being formed by forming rollers 14 (only one stage is illustrated in FIG. 1) provided to be multi-staged, and the edges overlapped in the lengthwise direction of the tubular web W are sealed (longitudinally sealed) in the longitudinal direction. Furthermore, after a part of web W is sealed (cross-sealed) in the direction orthogonal to the lengthwise direction of web W, a content is filled into a tubular web W located in the upstream side of the cross-sealed part, and after cross sealing is further carried out at a size equivalent to one container at the abovementioned web, said cross sealed part is cut off, thereby a hexahedral packaging container C is produced, in which the content is filled.

The tube forming device 3 is provided with a filling pipe 5 to fill a tube with a content such as fluid food, etc. and is provided with a pair of seal jaws 7 (only one jaw 7 is illustrated in FIG. 1, two pairs of cross seal jaws 7 are provided so as to vertically move) in order to seal the tubular web W from both the sides of the tubular web W via a drive mechanism (not illustrated) from the main shaft 6 of the packaging container producing equipment.

A pair of cross seal jaws 7 move downwards while pulling downward the tubular web W being transferred. After the seal jaws 7 falls down to an appointed distance, they release the sealing state of web W to cancel the downward transfer force of the tubular web W and move in such a direction of separating each other. Then, the seal jaws 7 are elevated to an appointed distance and repeat a sealing action of the tubular web W again.

At this time, as shown in a detailed view (only one of the pair is illustrated in this drawing) of the cross seal jaws 7 of FIG. 3, the abovementioned cross seal jaws 7 are provided with jaws 7*b* attached to a horizontal bar 7*a*, and web is nipped between a pair of jaws 7*b* to cause a cross sealing to be executed. Furthermore, lug folding flaps 7*c* rotating in the direction of the arrow A are attached to one of the cross seal jaws 7, wherein while web W is nipped between a pair of jaws 7*b*, the abovementioned lug folding flap 7*c* is able to fold lugs Wb formed at the web W.

On the other hand, specified printing patterns and detection marks a (See FIG. 6) such as a straw port for registering positions are provided at appointed intervals on the web W. As using the position of the abovementioned detection mark a as reference, it is necessary to adjust the feeding amount of web W (this is called "mark registration") in packaging container producing equipment so that detection marks a of printing surface of every packaging container C come to an appointed position.

However, since errors in positioning of patterns and straw port when printing on sheet-like web and changes of the feeding amount of web W due to defective rotations of rollers in the packaging container producing equipment are unavoidable, it is necessary to register the abovementioned marks at all times while the packaging container producing equipment is in operation. If the feeding amount enters such a state where it can not be adjusted by registering the abovementioned marks, there are cases where packaging containers C which are the final formed products can not be formed to their object shape.

Since ever, the mark registration is, as shown below, carried out by combination of (1) a method of adjusting the folding amount of web W in its transfer direction and (2) a method of adjusting the degree of tension applied to web W being transferred.

(1) Method of adjusting the folding amount of web W in its transfer direction (See FIG. 8)

The feeding amount of web W in the transfer direction is classified into the following two stages of action, wherein the first action is to adjust the feeding amount of web W in the transfer direction by a pulling intensity of web W, and the second action is to adjust the folding angle of lug part formed on web W. By combining these methods, the web W is transferred in the web transfer direction.

That is, mechanical feeding action of web W in the transfer direction consists of the following two actions shown in FIG. 8.

① By the sealing part of web W being nipped at both sides by a pair of cross seal jaws 7, the mechanical feeding action is carried out by pulling the web W equivalently to the moving amount of the cross seal jaws 7 in the web transfer direction (See FIG. 8(*a*)).

② The shape of web W taken along the line A—A in FIG. 8(*a*) is as shown in FIG. 8(*b*), and the lug part web Wb (See FIG. 11) is folded, as shown in FIG. 8(*c*), from both sides of tubular web W in the right angle direction with respect to the cross seal part Wa (See FIG. 11) formed by the abovementioned action ①.

The abovementioned actions ① and ② are basically for applying cross sealing to tubular web W, folding a lug part formed at the cross sealed part and finally forming a hexahedral body. However, by adjusting the folding angle of the lug folding flaps 7*c*, it is possible to adjust the feeding amount of web W.

An appointed amount of web W is sent in the abovementioned action ①, and the usual feeding action and corrective feeding action of web W, which will be described later, are carried out in the abovementioned action ②.

A detector 19 for detection mark a such as a specified printing pattern, straw port, etc. is installed, as shown in FIG. 6, at a specified point established in advance in packaging container producing equipment. Data signals detecting a detection mark a of web W of the abovementioned detector 19 and cam rotation angle signals of an encoder 22 for detecting the rotation angle of the main shaft 6 to which a cross seal jaw drive cam 24 is attached are inputted into a control device 23. The rotation angle of shaft 6 of the cam 24, which is secured at the point when the data signal of the abovementioned detection mark a is read, is regarded as a detection angle of the a deviation between the detection mark a in the abovementioned control device 23, and the detection angle of the abovementioned detection mark a and the reference angle established in advance is obtained, wherein a value responsive to the deviation is outputted, via a solenoid valve 25, to the pneumatic cylinder 26 for adjusting the folding amount of lug folding flaps 7*c* (FIG. 3) of the cross seal jaws 7.

As shown in FIG. 7, lug folding cam 27 is able to take positions ① and ② in FIG. 5 by the pneumatic cylinder 26. Since a roller 28 moves on the cam surface when the lug folding cam 27 is at the position ①, the lug folding flap 7*c* carries out a corrective action of folding to the position shown in FIG. 9(*b*), and since the roller 28 moves on the cam surface when the lug folding cam 27 is at the position ②), the lug folding flaps 7*c* carries out a usual feeding action of folding to the position shown in FIG. 9(*a*).

The lug folding angle of web W of the lug folding flaps 7*c* is established from a deviation between the detection angle of the detection mark a by the detector 19 and the reference angle established in advance, in such a manner that a usual feeding action which produces a web feeding amount obtained by adding only 0.5 mm to the reference feeding amount is employed until a detection value equivalent to the value obtained by adding only 1.5 mm to the reference feeding amount is obtained as for the web feeding amount, and as the detection value equivalent to a value obtained by adding only 1.5 mm to the reference feeding amount is obtained as for the web feeding amount, a corrective feeding action which produces a web feeding amount obtained by subtracting only 1.0 mm from the reference feeding amount is employed.

In FIG. 9, FIG. 9(*a*) is a view explaining a usual feeding action of web W and FIG. 9(*b*) is another view explaining a corrective feeding amount of web W. In the usual feeding action of web W in FIG. 9(*a*), web W is fed at the initial set value equivalent to the web feeding amount obtained by adding only 0.5 mm to the reference feeding amount (the feeding amount which becomes a reference on design) at a folding angle A° of the lug folding flaps 7*c*.

Web feeding amount in the usual feeding action= Reference feeding amount+0.5 mm.

Furthermore, the folding angle of the lug folding flaps 7*c* is changed to angle B° in the corrective feeding action of web W shown in FIG. 9(*b*) to secure the feeding amount obtained by subtracting only 1.0 mm from the abovementioned reference feeding amount.

Web feeding amount in the corrective feeding action= Reference feeding amount−1.0 mm As regards the abovementioned web W feeding amounts [−1.0 mm] or [+0.5 mm], the detailed figures are used for only making the explanation more understandable. That is, the usual feeding action and corrective feeding action of the invention are not limited to these figures.

Conventionally, the feeding control of web W was controlled by only the abovementioned usual feeding action and corrective feeding action of the lug folding flaps 7*c*. For example, where it is assumed that there is no printing error (no slip of the detection mark a) of web W, and there is nothing abnormal in the feeding amount of the feeding roller 10, guide roller 11, etc., as shown in FIG. 10 (*a*), the folding angle of the lug folding flaps 7*c* is changed to angle B°, as shown in FIG. 9(*b*), and the action is changed to a corrective feeding action at the point of time (after the usual feeding action is performed two times) when web W is excessively fed 0.5 mm each by the abovementioned usual feeding amount made by the lug folding flaps 7*c* and web W is excessively fed 1.5 mm which is the allowance of slip from the reference feeding amount.

Web W, the slip of which became 0.5 mm from the reference feeding amount by the corrective feeding action, is caused to enter the usual feeding action again. In a case where there is no slip of the detection mark a such as a printing error of web W and there is nothing abnormal in the feeding amount of feeding roller 10, guide roller 11, etc., the abovementioned corrective feeding amount is carried out once every three feeding actions (See FIG. 10 (*a*)).

However, herein, since web W is excessively fed 0.5 mm per usual feeding action if a slip of the detection mark a of web W such as a printing error is, for example, +0.5 mm, the slip from the reference feeding amount in total becomes 1.5 mm per usual feeding action, wherein the feeding is changed to a corrective feeding action after the usual feeding action is performed once. Therefore, the corrective feeding action is executed once every two feeding actions as shown in FIG. 10(*b*). If the control device 23 judges that, in the usual feeding action, a slip from the reference feeding amount became 1.5 mm, the action is changed to the corrective feeding action.

Furthermore, since web W is excessively fed 0.5 mm in the usual feeding action if a slip of the detection mark a of web W is, for example, −0.25 mm each, the feeding action is separated 0.25 mm each from the reference position in one usual feeding action in total, and at the point of time when the slip from the reference feeding amount becomes 1.5 mm, the action is changed to a corrective feeding action. Therefore, as shown in FIG. 10(*c*), the corrective feeding action is executed once every five feeding actions.

(2) Method of adjusting the degree of tension applied onto web W being transferred In order to accurately cause web W to move an appointed distance without fail by the method (*1*) of adjusting the web feeding amount by adjustment of the folding angle by the lug folding flaps 7*c*, it is necessary to give adequate fixed tension to web W by the tension pressing device 2. For example, if the tension of web W is too intensive, a mechanical slip occurs between web W and its feeding members, thereby causing the movemental amount of web W to be decreased. To the contrary, if the web tension is too weak, the web is slackened to cause the web W to be transferred beyond the necessity.

In order to give an adequate tension to web W, tension pressing device 2 is composed of a web W feeding roller 10, a guide roller 11*a,* a dancer roller 9 disposed therebetween, a pair of rocking arms 12 having the abovementioned dancer roller 12 at its tip end, which causes the dancer roller 12 to rock, a rotation shaft 13 of the rocking arm 12 secured at the base end of the abovementioned pair of rocking arms 12.

The abovementioned mark registration is carried out by combination of the method (2) and the abovementioned method (1).

As described above, a corrective action of the feeding amount is carried out by the lug folding flaps 7*c* for a slight change (for example, 1% of the prescribed value) of the feeding amount of web W. However, it is necessary that a change (error) of the feeding amount of web W, for example, the average error of each time for 100 pitches of web feeding action equivalent to one packaging container C is less than an appointed value (for example, ±0.5 mm or less) and a change (error) of the feeding amount of web per pitch of the web feeding action equivalent to one packaging container C does not exceed an appointed value (for example ±1.5 mm).

Furthermore, the more the consumption of roll-like web W becomes, the more frequently occurs a case where a slip of the detection marks a correctable by the abovementioned method (1) of adjusting the folding amount of web in the transfer direction exceeds the permissible range of correction of the mark registration, wherein it becomes impossible to correct the feeding amount of web W.

For example, in three pattern examples shown in FIG. 10(*a*) through FIG. 10(*c*), if a slip of the detection mark a from the reference feeding amount, such as a printing error of web W, is +1.0 mm per pitch of the abovementioned actions, the slip exceeds the allowance range of detection error at once, thereby causing faulty containers C to be produced. In some cases, packaging container producing equipment is unavoidably caused to come to a stop. Furthermore, if a slip of the detection mark a is continuously, for example, −0.5 mm or more per pitch, the slip goes beyond the reference feeding amount line (See FIG. 10) equivalent to the reference feeding amount, the correction of the feeding amount of web W becomes impossible.

Furthermore, by repeating the usual feeding action and corrective feeding action through adjustment of folding angle by the abovementioned lug folding flaps 7*c*, there was such a case where packaging containers C of slightly different shape are produced, the roundness of lug part Wb of web W, for example, is too round, or the corner is too keen.

As regards packaging containers C formed by the corrective feeding action, since the folding degree of the lug part Wb is weaker than the reference value, there is a possibility of producing faulty packaging containers C, that is, faulty products, in which sufficient welding is not carried out in the welding process with the body portion having a rectangular section, which is carried out in the subsequent process regarding the formation of web W. Furthermore, inconvenient folding wrinkles may be produced at the corner parts when the final hexahedral body is formed.

Thus, prior arts have a problematic point by which it is possible to adjust the feeding amount of web W while continuously running the machine since the range of adjustment of the feeding amount of web W is narrow.

Therefore, it is an object of the invention to eliminate the deficits of the prior arts.

It is an object of the invention to quickly eliminate an error of detection mark registrations such as a printing error on web W, and to provide packaging containers, free from any unevenness in shape, for which the range of adjustment of the feeding amount of web W can be widened, the adjustment of the feeding amount of web W can be carried out with the machine running, and the formability of which is further improved.

DISCLOSURE OF THE INVENTION

The themes and objects of the invention can be solved by the following construction.

Packaging container production equipment for forming tubular web from sheet-like web and producing hexahedral packaging containers, comprises: a web tension pressing means provided with a rocking arm and a rocking roller secured at the tip end thereof, which transfers sheet-like web while pressing the sheet-like web by the rocking roller; a web tension pressing force setting means for setting the pressing force of said tension pressing means; a sealing member for forming sealing parts at tubular web by pressing both sides of the tubular web while folding both the sides of said tubular web in the direction orthogonal to the lengthwise direction of the tubular web obtained from sheet-like web, and simultaneously transferring web at an appointed feeding amount; a mark detecting means for detecting that specified detection marks which will be targets on the web are fed onto the points of detection which will be the specified references established in advance; and a web tension pressing force controlling means for escalationally or continuously adjusting the pressing force set value of web tension pressing force setting means to an optimal value in response to the deviation between a timing when said specified mark detecting means detects a specified detection mark on said web at a specified point, and a timing when a specified printing detection mark is detected, which will be a reference established in advance at said specified point of detection.

Furthermore, a packaging container production method for forming tubular web from sheet-like web and producing hexahedral packaging containers, comprises the steps of: transferring sheet-like web while controlling a tension pressing force to an optimal value with respect to the sheet-like web; forming tubular web from the sheet-like web being transferred; nipping both the sides of the tubular web in the direction orthogonal to the lengthwise direction said tubular web and forming a sealing part at the tubular web by folding the same, and simultaneously transferring web at an appointed feeding amount; and continuously or escalationally controlling the web tension pressing force so as to become an optimal value in compliance with the deviation between the timing when a specified detection mark on the web is sent to a point of detection which becomes a specified reference established in advance and the timing when a specified detection mark is detected, which will be the reference established in advance at said specified point.

With the invention, in the packaging container producing equipment, the operation amount (folding angle etc.) of a sealing member (for example, lug folding flaps), which forms a sealing part at tubular web by pressing both sides of the tubular web while folding the same, is set to an appointed idealistic value in order to secure a prescribed web W feeding amount, thereby causing the tension given to web W being transferred to be controlled. Therefore, in a case where correction is necessary for the web feeding amount, the correction is carried out by controlling the tension operating on the web W while always keeping the operating amount (folding angle) of the sealing member (for example, lug folding flaps) fixed.

As a tension pressing force setting means of the invention, an actuator may be used, which is represented by a pneumatic cylinder, a hydraulic cylinder provided with a pressure change unit for generating pressure to press the rocking arm in multistage or an electro-pneumatic proportional valve for stagelessly generating pressure proportionate to a size of electric signals.

According to the invention, it is possible to adjust the feeding amount of web W by controlling a pressing force given to web W in the tension pressing device, in compliance with a deviation of a detection mark such as a specified printing pattern on the printing surface of web W from the reference value of detection value.

It is preferable that the deviation of the detected value of detection marks such as a printing pattern on the printing surface on web W from the reference values is based on the deviation between the reference set value of the rotating angle or number of times of rotation of the main shaft of the packaging container producing equipment and the detected value of the detection marks. This is because that the drive amount of almost all the drive parts of the packaging container producing equipment such as cross seal jaws, container forming conveyor, etc. depend upon the value of the rotating angle and the number of times of rotations of the main shaft, However, not depending the rotating angle and the number of times of rotations of the main shaft, the deviation of the detected value of the abovementioned specified detection marks from the reference value may be measured on the basis of the drive amount of the other drive parts.

With the invention, in addition to the abovementioned construction, the web tension pressing means is provided with a dancer roller rocking in the vertical direction and a web feeding roller having a drive force for sending web W into the transfer direction, and the web tension pressing force controlling means is provided with position detecting means of the upper limit and lower limit positions of a dancer roller rocking in the vertical direction and a construction capable of changing the sheet-like web to a high-speed set value and low-speed set value by the feeding roller by detecting the upper limit and lower limit positions of the dancer roller of each of the abovementioned position detection means, wherein it is possible to further widen the adjustment width of the web feeding amount.

Thus, with the invention, the range of correction can be expanded in comparison with the range of correction of the conventional web W feeding amount, and the allowable range for unevenness of detection marks such as a printing error on web W can be also expanded. Therefore, it is possible to perform consecutive operation of the machine without stopping, and it is possible to produce packaging containers in which detection marks such as printing patterns can be correctly placed at appointed positions, thereby causing faulty products not to be produced.

DESCRIPTION OF THE PREFERRED EMBODIMENTS

A description is given of a preferred embodiment of the invention.

Figure 1:
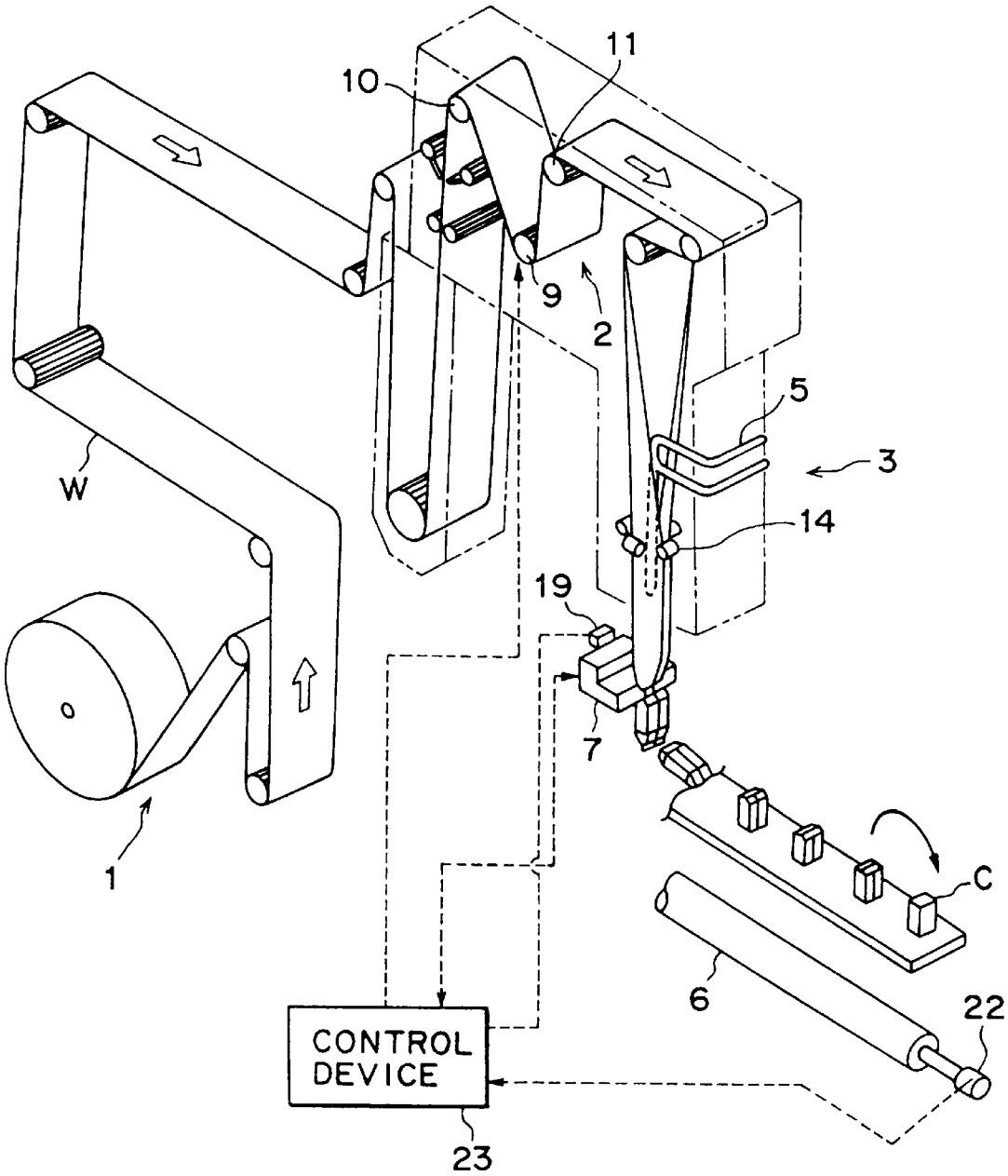
FIG. 1 is a sketch of equipment for producing packaging containers, in which a content is filled, from sheet-like web according to a preferred embodiment of the invention.
Figure 2:
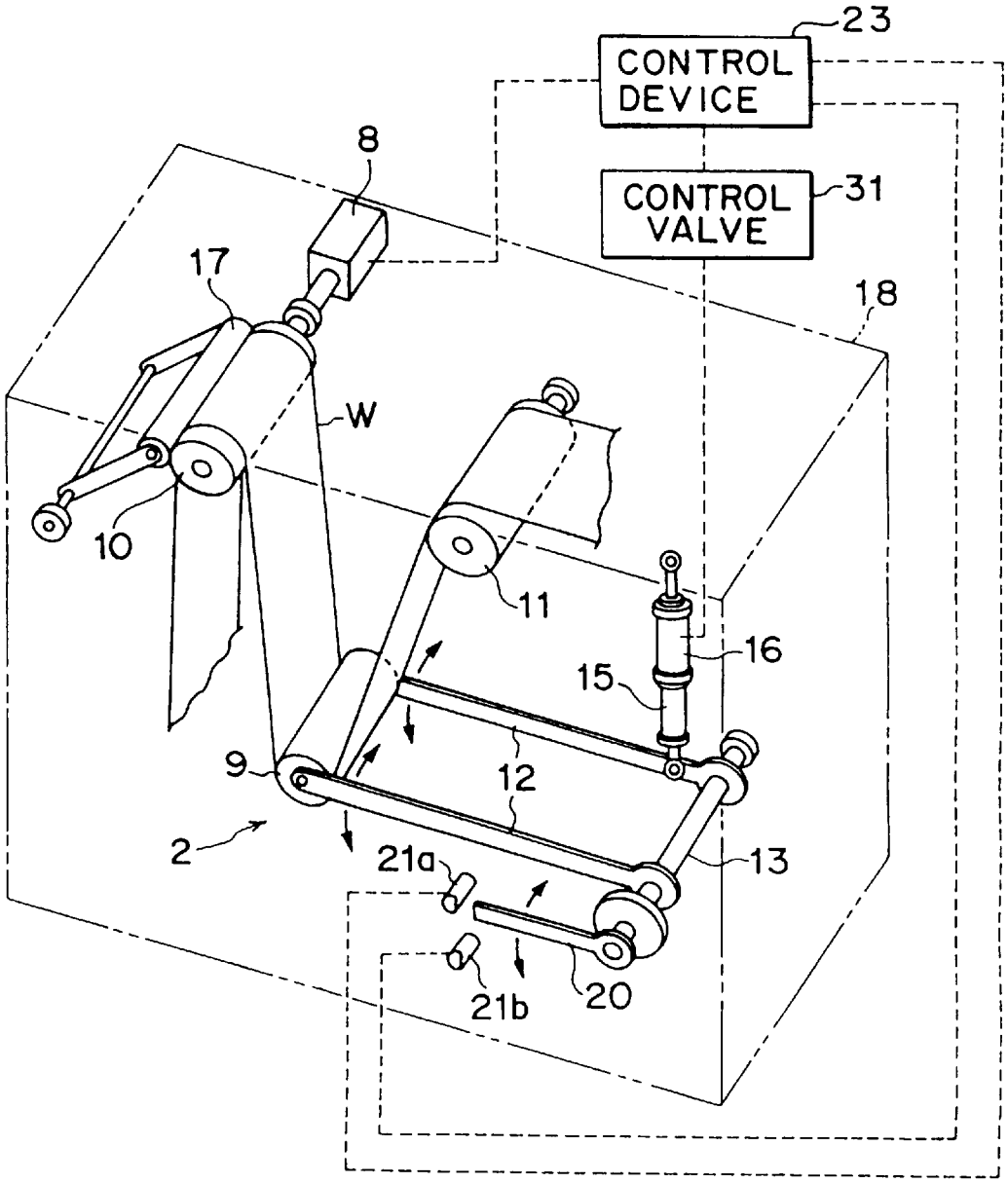
FIG. 2 is a rough perspective view of a tension pressing device of the packaging container producing equipment of FIG. 1, FIG. 3 are the cross seal jaw of the packaging container producing equipment of FIG. 1.

Packaging container producing equipment according to a preferred embodiment of the invention is composed of the same construction as the packaging container producing equipment described in FIG. 1. FIG. 2 is a sketch of a tension pressing device of web W being transferred, which is not illustrated in the packaging container producing equipment of FIG. 1, FIG. 3(*a*) is an enlarged perspective view of web cross seal jaws 7, and FIG. 3(*b*) is a top view thereof. FIG. 4 is a view of a drive mechanism of lug folding flaps, which keeps the operating amount (folding angle) of the lug folding flaps 7*c* fixed.

Herein, reference parts of members having the same feature as those of equipment described in the conventional example are given the same reference numbers in the equipment of the invention, and the description thereof is omitted.

Packaging container producing equipment according to a preferred embodiment of the invention is as described above, with reference to FIG. 1, wherein tubular web W is transferred while being pulled by a pair of cross seal jaws 7 moving downward, in the process of pressing the abovementioned web W from the direction orthogonal to the lengthwise direction of tubular web W by the pair of cross seal jaws 7. At this time, while web Wa (FIG. 11) is being nipped between a pair of jaws 7*b* of the cross seal jaw 7, the lug folding flaps 7*c* folds the lug parts Wb formed at the web W at an appointed angle.

Therefore, tubular web W is transferred downward by movement and folding while the web W is nipped by a pair of cross seal jaws 7 in the tube forming device 3. However, after the pair of cross seal jaws 7 carry out feeding of web W for an appointed distance while going downward, they repeat an elevating movement.

On the other hand, the tension pressing device 2 is to control the feed rate and feeding amount of web W inside the packaging container producing equipment or to apply tension to the web W at all times since the formability is worsened and the web feeding amount becomes unstable unless tension is applied to the web when tubular web in which a content is filled is formed to be square-column-like web W by forming members (not illustrated).

FIG. 2 is a perspective view of tension pressing device 2. The tension pressing device 2 is provided with a dancer roller (rocking roller) 9 which is disposed between a feeding roller 10 driven by drive means 8 having a clutch to send out web W in the transfer direction and a guide roller 11 and is rockable in the direction almost orthogonal to the web transfer direction; a pair of rocking arms 12 which have the abovementioned dancer roller 9 at its tip end and causes the dancer roller 9 to rock; a rotating shaft 13 secured at the base of the abovementioned pair of rocking arms 12, which transmits a drive force to the rocking arms 12; and a pneumatic cylinder 16 (a hydraulic cylinder or a motor other than a pneumatic cylinder may be acceptable) for driving said rotating shaft 13 via a lever 15.

The pneumatic cylinder 16 is provided with a control valve 31 for stagelessly controlling the air pressure according to electric current proportional to the deviation between the rotation angle of the main shaft 6 (FIG. 1) and the reference rotation angle. A control valve (not illustrated) which stagelessly controls the air pressure may be provided instead of the control valve 31.

Furthermore, a pressing roller 17 which transmits a transfer force to web W transferred between the pressing roller 17 and the feeding roller 10 is provided at the position opposite the feeding roller 10.

As shown in FIG. 2, although the rotating shaft (not illustrated) of the feeding roller 10 and guide roller 11 is supported at the wall of germfree chamber 18, the dancer roller 9 is not supported at said wall. The dancer roller 9 is able to move in the direction almost orthogonal to the feeding direction of web W with respect to rocking of the rocking arm 12.

In a preferred embodiment of the invention, differing from prior arts described in FIG. 9 and FIG. 10, since the folding angle of the lug folding flap 7*b* (provided at only one cross seal jaw 7 of a pair of cross seal jaws 7 consisting of two sets) of the cross seal jaws 7 is set to an appointed angle, the following method to adjust the tension pressing force onto web W exclusively by the web tension pressing device 2 is employed as a method for adjusting the feeding amount of web W to solve a slip of printing patterns on web W.

The method has a construction in which the tension pressing force of the dancer roller 9 to web W is continuously controlled by the tension pressing device 2. As shown in FIG. 2, a pneumatic cylinder 16 for driving the abovementioned rocking arm rocking shaft is provided at the rocking arm 12 having a dancer roller 9 at its tip end, wherein a control valve 31, for example, an electropneumatic proportional valve which is able to stagelessly control the air pressure according to the intensity of electric current is employed thereat, and by this control valve 31, an electric current having intensity proportional to the size of the deviation value a detection mark a such as a printing pattern on web W from the abovementioned reference position of the mark position is inputted to stagelessly change the air pressure of the pneumatic cylinder 16 for driving the rocking arm rocking shaft, thereby causing the tension applied onto web W to be controlled and its feeding amount to be adjusted.

At this time, as described above, an air pressure change valve which is able to control the air pressure in multistage may be employed as the control valve 31.

Figure 5:
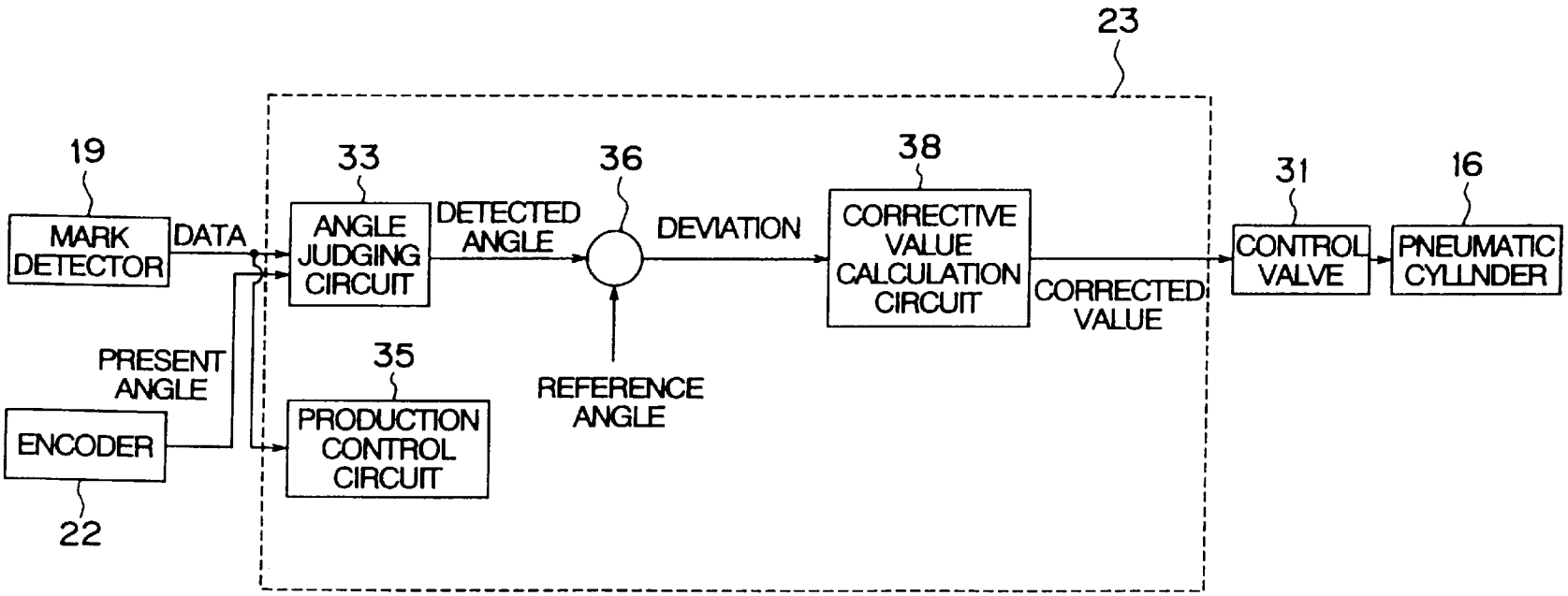
FIG. 5 is a block diagram of a control device of tension pressing force of packaging container producing equipment of FIG. 1.

FIG. 5 shows a block diagram of a control device which controls a pressing force of web tension pressing device by the control valve 31.

A detector 19 of detection mark a (FIG. 4) of web W is provided in the vicinity of cross seal jaws 7 of tube forming device 3 (FIG. 1), and the main shaft 6 is provided with an encoder 22 (FIG. 1, FIG. 4). As a detection mark a of web W passes at the detector 19, the detection mark a is read by the detector 19. Data read by the detector 19 is inputted into the main shaft rotation angle judging circuit 33 of the control device 23. Furthermore, the rotation angle of the main shaft 6 detected by the encoder 22 is inputted into the main shaft rotation angle judging circuit 33. The main shaft rotation angle judging circuit 33 regards the rotation angle of main shaft 6 as the mark detected angle at the point of time when data of the detection mark a read by the detector 19 is inputted. The data of the detector 19 is inputted into a production control circuit 35 and may be used as data for production control.

The detected angle of the main shaft 6 is inputted into the subtracter 36. Since the reference angle (rotation angle which becomes a reference, established in advance, of the main shaft detected by the encoder 22 when the detection mark a of web W passes at the detector 19) is inputted into the subtracter 36, the deviation between the detected angle and the reference angle is obtained, and the deviation value is inputted into a corrective value calculation circuit 38. A corrective value for the abovementioned deviation value is obtained by the corrective value calculation circuit 38, and an electric signal corresponding to the obtained corrective value is outputted from the control device 23 to the control valve 31 of the tension pressing device 2, thereby causing the air pressure to be stagelessly changed, wherein the pressing force onto web W is controlled to stagelessly change the feeding amount of web W, and then an optimal feeding amount of web W is obtained.

Thus, the tension for pressing web W is changed, using the pneumatic cylinder 16 for driving the rocking arm rocking shaft of the tension pressing device 2, and a slip of the detection mark a such as a printing pattern of web W is absorbed, wherein it is possible to further widen the correctable range of the web W feeding amount than in the prior arts, regardless of that the mechanism feeding amount of web W by cross seal jaws 7 per time is fixed.

As described above, according to a preferred embodiment of the invention, since the pressing force of web is escalationally or stagelessly controlled by the web tension pressing device 2, the allowance range of a corrective feeding action of the web W feeding amount can be further widened than in the prior arts, wherein even though a change of the web W feeding amount is greater than in the prior arts, no faulty product is produced.

Next, a description is given of another preferred embodiment in which, by controlling the pressing force onto web by the abovementioned web tension pressing device 2, it is possible to operate the feeding roller 10 (FIG. 2) at two speeds, high speed and low speed, in addition to adjustment of the web W feeding amount, and tension fluctuation is decreased by securing the amount of accumulation of the web W tension.

Since the web transfer channel is long, the web treads a complicated channel with its transfer direction changed many times, and the distance is long, a transfer force of the feeding roller 10 is used in addition to the web transfer force of cross seal jaw 7. However, it is remarkably difficult to completely coincide the web feedrate with the feedrate of the web feeding roller 10 by the cross seal jaw 7.

Therefore, in order that the tension or feedrate of web at the tension pressing device 2 including the feeding roller 10 does not influence the web feedrate at the cross seal jaw 7, it is necessary to secure the amount of accumulation by the tension pressing device 2 consisting of web feeding roller 10, etc., so as to correspond to changes of the feedrate of web W due to the cross seal jaw 7.

Therefore, it is constructed that a rocking type dancer roller 9 is provided at the feeding roller 10 part and the feeding roller 10 is able to be changed to high-speed operation and low-speed operation. Thereby, the tension applied onto web W can be controlled and kept to be fixed.

When the feeding roller 10 is operated at a low speed, the dancer roller 9 is slowly elevated, and when the dancer roller 9 reaches the upper dead point, the feeding roller 10 is changed to a high-speed operation to cause the feeding amount of web to be increased. The dancer roller 9 is slowly lowered. When the dancer roller reaches the lower dead point, it is changed to a low-speed operation again to cause the feeding amount (feedrate) of web W per unit time to decreased. Then, the dancer roller 9 is elevated to cause the tension operating on the web W to be controlled and kept to be fixed.

With reference to FIG. 2, a detailed description is given of a mechanism of controlling and keeping the tension operating onto web W to be fixed by changing the feeding roller 10 to high-speed or low-speed operation, wherein although the feeding roller 10 is driven by a drive means 8 having a clutch, the transfer force for web W is generated while the web W is being nipped between the feeding roller 10 and pressing roller 17. The pressing roller 17 is able to give a pressing force to the feeding roller 10 by using a fluid cylinder (not illustrated). Furthermore, rotation shaft 13 of the rocking arm 12 of the dancer roller 9 is provided at the wall of the germfree chamber 18 so as to penetrate the wall, and an operating arm 20 is fixed outside the wall of the corresponding chamber, wherein the operating arm 20 is elongated in a direction parallel to the rocking arm 12. The upper-limit position detector 21*a* and lower-limit position detector 21*b* are respectively provided at the outer wall side of the germfree chamber in the vicinity of the operating area at the tip end of the operating arm 20.

Although the driving means 8 of the feeding roller 10 is operated at two stages, high speed and low speed, web W is intermittently sent in the process of forming it from tubular web W to hexahedral packaging containers C (FIG. 1). If it is assumed that it is continuously sent, the feeding amount per unit time is made a reference feeding amount. In this case, the operating speed of the driving means 8 is established so that the feeding amount of web W by the feeding roller 10 exceeds the reference feeding amount when the driving means 8 is operated at the high speed, and the feeding amount of web W by the feeding roller 10 becomes less than the reference feeding amount when the driving means 8 is operated at a low speed.

Since the feeding amount of web W by the feeding roller exceeds the reference feeding amount if it is assumed that the driving means 8 is operated at the high speed, the web W is slackened, and the slackening thereof is gradually increased, and the dancer roller 9 is caused to go down by a pressing force of the pneumatic cylinder 16.

Therefore, the rocking arm 12 rotates downward centering around its rotating shaft 13, and the operating arm 20 rotates in the same direction as that of the rocking arm 12 via its rotation shaft 13. In the meantime, as the tip end part of the operating arm 20 reaches the position opposite the lower limit position detector 21*b*, the same detector 21*b* detects this. At this time, the same detector 21*b* outputs a lower limit position signal, and the control device 23 changes the high speed operation of the driving means 8 to the lower speed operation on the basis of the output signal.

If so, since the feeding amount of web W by the feeding roller 10 becomes less than the reference feeding amount this time, the slackening of web W is gradually decreased, and the dancer roller 9 is elevated by being pulled by the web W. At this time, the operating arm 20 rotates in the reverse direction of the abovementioned direction, and as the tip end part comes to the position opposite to the upper limit position detector 21*a*, the same detector 21*a* outputs an upper limit position signal, wherein the driving means 8 is changed from the low speed operation to the high speed operation again.

Thus, although the dancer roller 9 repeats vertical movements in a range that the upper limit position and lower limit position detectors 21*a*, 21*b* detect the operating arm 20, web W is given tension resulting from the pressing force by the pneumatic cylinder of the dancer roller 9 in the meantime, wherein the web W is continuously sent at all times. Therefore, it is possible to keep the tension, applied onto the web W, fixed at all the times. Furthermore, since the upper limit and lower limit detectors 21*a*, 21*b* are disposed outside the germfree chamber 18, any trouble of the upper and lower limit position detectors 21*a*, 21*b* resulting from high temperature inside the germfree chamber 18 can be eliminated.

As described above, according to the invention, the allowance range of the corrective action of web feeding amount by the cross seal jaws 7 can be further widened than in the prior arts by controlling the web tension pressing force, and if a change (error) of the feeding amount of web W is greater than in the conventional examples, no faulty products can be produced.

What is claimed is:

1. An apparatus for making a packaging container from a sheet-like web comprising:

a web feeding roller for transporting the sheet-like web along a feed path in a direction lengthwise of the sheet-like web, said web feeding roller having at least two modes of operation including a high-speed mode and a low-speed mode, said web feeding roller transporting said sheet-like web at first rate in its high-speed mode and transporting said sheet-like web at a second rate, lower than said first rate, in its low-speed mode;

a web tensioning device including a pivotally mounted rocking arm and a dancer roller rotatably secured at a distal end of said rocking arm, said dancer roller applying a pressing force against the sheet-like web while said web tensioning device pivots between upper limit and lower limit positions;

detection means for detecting the presence of said web tensioning device at said upper limit and said lower limit positions;

web feed rate control means for switching operation of said web feeding roller between said high speed and low speed modes responsive to detection of said web tensioning device at said upper limit and lower limit positions;

tube forming means for forming the sheet-like web into a tubular web;

sealing means for sealing portions of the tubular web by pressing together opposing sides of the tubular web, said sealed portions of said tubular web extending in a direction orthogonal to the lengthwise direction of the tubular web;

mark detecting means for detecting registration and timing of predetermined detection marks on the web with points of detection established in advance;

a drive cylinder connected to said rocking arm for setting the pressing force applied by said tensioning device; and web tension control means for controlling said drive cylinder to change the value for pressing force set by said drive cylinder responsive to variation in the timing of the detected registration.

2. An apparatus for forming a packaging container in accordance with claim 1 wherein said drive cylinder is a fluid-actuated cylinder connected to said rocking arm and wherein said web tension control means changes fluid pressure fed to said fluid-actuated cylinder responsive to the variation in timing of the detected registration.

3. A method for forming a packaging container from a sheet-like web comprising:

transporting the sheet-like web along a feed path in a high speed mode or a low speed mode, said high speed mode transporting said sheet-like web at a first rate and said low speed mode transporting said sheet-like web at a second rate, lower than said first rate;

tensioning said sheet-like web, by applying a pressing force against said sheet-like web with a tensioning member which moves between an upper limit position and a lower limit position;

detecting the presence of said tensioning member at said lower limit position and at said upper limit position and switching between said high speed mode and said low speed mode in accordance with said detection;

forming said sheet-like web into a tubular web;

gripping opposing sides of the tubular web to press said opposing sides together along a transverse section of said tubular web extending in a direction orthogonal to the lengthwise direction and sealing said transverse section;

pulling the gripped web to advance the tubular web a predetermined distance;

detecting registration and timing of predetermined detection marks on the web with points of detection established in advance; and controlling the pressing force of the web tensioning member responsive to variation in the timing of the detected registration.

* * * * *

UNITED STATES PATENT AND TRADEMARK OFFICE

CERTIFICATE OF CORRECTION

PATENT NO. : 6,067,778
DATED : May 30, 2000
INVENTOR(S) : Hidekimi Yamamoto et al.

It is certified that error appears in the above-identified patent and that said Letters Patent is hereby corrected as shown below:

The title page should be deleted and substitute therefore the attached title page.

Delete the specification and substitute the specification as shown on the attached page.

Signed and Sealed this

Twenty-fourth Day of June, 2003

JAMES E. ROGAN
*Director of the United States Patent and Trademark Office*

United States Patent [19]

Yamamoto et al.

[11] Patent Number: 6,067,778

[45] Date of Patent: May 30, 2000

[54] PACKAGING CONTAINER PRODUCTION EQUIPMENT AND PACKAGING CONTAINER PRODUCTION METHOD

[75] Inventors: Hidekimi Yamamoto; Akimasa Fujimoto; Michio Ueda, all of Itano-gun, Japan

[73] Assignee: Shikoku Kakoki Co., Ltd., Japan

[21] Appl. No.: 09/084,173

[22] Filed: May 26, 1998

[30] Foreign Application Priority Data

May 30, 1997 [JP] Japan ..... 9-141538

[51] Int. Cl.[7] ..... B65B 9/22; B65B 57/04

[52] U.S. Cl. ..... 53/451; 53/51; 53/674; 53/551; 53/389.2; 226/30; 242/417.3; 242/418.1; 493/29; 493/302

[58] Field of Search ..... 53/51, 64, 551, 53/389.2, 451, 389.4; 226/28, 29, 30, 31, 44; 292/417.3, 418.1; 493/23, 29, 302

[56] References Cited

U.S. PATENT DOCUMENTS

| | | | |
|---|---|---|---|
| 2,636,732 | 4/1953 | Howard | 53/551 |
| 3,116,032 | 12/1963 | Roberts | 242/417.3 |
| 3,417,674 | 12/1968 | Abrahamson | 53/51 |
| 3,787,001 | 1/1974 | Henry | 53/51 |
| 4,033,522 | 7/1977 | Chestnut et al. | 242/418.1 |
| 4,074,504 | 2/1978 | Greenwalt et al. | 53/551 |
| 4,129,238 | 12/1978 | Herd | 226/29 |
| 4,262,474 | 4/1981 | Reuter et al. | 53/551 |
| 4,566,253 | 1/1986 | Jones | 53/551 |
| 5,317,858 | 6/1994 | Hanai | 53/551 |
| 5,480,085 | 1/1996 | Smithe | 242/418.1 |

*Primary Examiner*—John Sipos

*Attorney, Agent, or Firm*—Lorusso & Loud

[57] ABSTRACT

A packaging container production apparatus and method for forming a tubular web from sheet-like web and for producing hexahedral packaging containers, wherein in order to secure a prescribed web W feeding amount, the extent of movement of lug folding flaps, which form a seal in tubular web by pressing opposing sides of the tubular web while folding the same, is set to an ideal value, tensioning pressure is generated through a fluid-operated cylinder by a control device via a control valve, in accordance with a deviation from registration of a detection mark such as a specified printing pattern on the printed surface of web W with a reference position. The tension is applied to web W through a dancer roller.

3 Claims, 11 Drawing Sheets

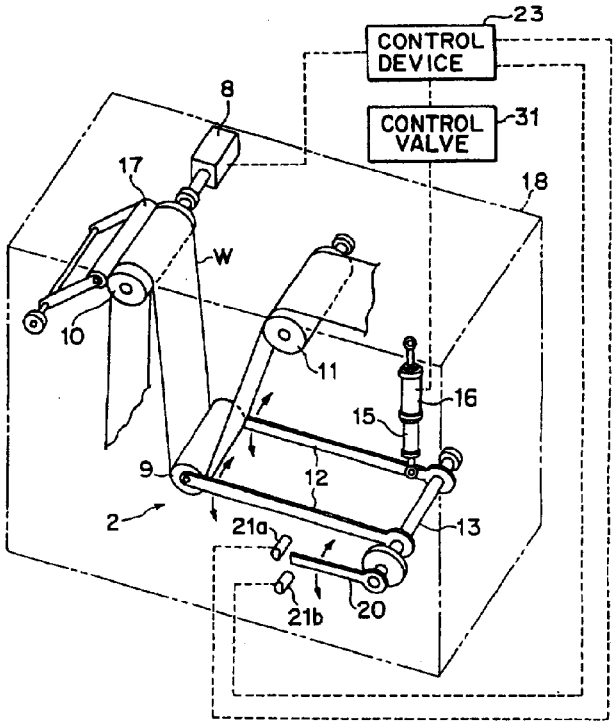

PACKAGING CONTAINER PRODUCTION EQUIPMENT AND PACKAGING CONTAINER PRODUCTION METHOD

TECHNICAL FIELD

The present invention relates to packaging container producing equipment and a packaging container producing method, in particular to packaging container producing equipment and a packaging container producing method of forming a sheet-like web into a tubular web and filling said tubular web with contents such as fluid food.

BACKGROUND ART

In packaging container producing equipment for producing packaging containers, into which a content is filled, from sheet-like web, rolled sheet-like web W of rewinder 1, is transferred by web feeding roller 10 and is sent to tube forming device 3 via tension pressing device 2 consisting of a dancer roll (rocking roller) 9, which gives tension to the above-mentioned web W at all times, and guide roller 11, wherein the sheet-like web W is formed into tubular web W by multiple stages of forming rollers 14 (only one stage is illustrated in FIG. 1), and the edges overlapped in the lengthwise direction of the tubular web W are sealed (longitudinally sealed) in the longitudinal direction. Furthermore, after a part of web W is sealed (cross-sealed) in the direction orthogonal to the lengthwise direction of web W, a content is filled into the tubular web W located at the upstream side of the cross-sealed part, and after cross sealing is further carried out at a length equivalent to one container in the above-mentioned web, said cross sealed part is cut off, whereby a hexahedral packaging container C is produced with the contents filled therein.

The tube forming device 3 is provided with a filling pipe 5 to fill a section of the tube with contents such as fluid food, etc., and is provided with a pair of seal jaws 7 (only one jaw 7 is illustrated in FIG. 1) in order to seal the tubular web W from opposing sides of the tubular web W via a drive mechanism (not illustrated) operated from the main shaft 6 of the packaging container producing equipment.

A pair of cross seal jaws 7 moves downwards while pulling the tubular web W. After the seal jaws 7 move down a predetermined distance, they release the web W to cancel the downward transfer force on the tubular web W and move to separate from each other. Then, the seal jaws 7 are elevated the predetermined distance and repeat their sealing action on the tubular web W again.

As shown in a detailed view (only one of the pair is illustrated in this drawing) of the cross seal jaws 7 of FIG. 3, the above-mentioned cross seal jaws 7 are provided with jaws **7*b* attached to a horizontal bar 7*a*, and the web is nipped between a pair of jaws 7*b* to cause a cross sealing to be executed. Furthermore, lug folding flaps 7*c* rotatable in the direction of the arrows A are attached to one of the cross seal jaws 7, whereby, while web W is nipped between a pair of jaws 7*b*, the above-mentioned lug folding flaps 7*c*** are able to fold lugs Wb formed in the web W.

Specified printing patterns and detection marks a (see FIG. 6) , such as a straw port for registering positions, are provided at appointed intervals on the web W. Using the position of the above-mentioned detection mark a as reference, it is necessary to adjust the feeding amount of web W (this is called "mark registration") in packaging container producing equipment so that detection marks a of the printed surface for each packaging container C come to an appointed position.

However, since errors in positioning of patterns and straw ports when printing on sheet-like web and changes of the feeding amount of web W due to defective rotations of rollers in the packaging container producing equipment are unavoidable, it is necessary to register the above-mentioned marks at all times while the packaging container producing equipment is in operation. If the feeding amount becomes such that it can not be adjusted by registering the above-mentioned marks, there are cases where packaging containers C which are the final formed products can not be formed to their intended shape.

Mark registration is, as shown below, carried out by combination of (1) a method of adjusting the folding amount of web W in its transfer direction and (2) a method of adjusting the degree of tension applied to web W being transferred.

(1) Method of Adjusting the Folding Amount of Web W in its Transfer Direction (See FIG. 8)

The feeding amount of web W in the transfer direction is adjusted in two stages of action, wherein the first action is to adjust the feeding amount of web W in the transfer direction by a pulling force of web W, and the second action adjusts the folding angle of a lug portion formed on web W. By combining these methods, the web W is transferred in the web transfer direction.

The mechanical feeding action of web W in the transfer direction consists of the following two actions shown in FIG. 8.

① By the sealing part of web W being nipped at both sides by a pair of cross seal jaws 7, the mechanical feeding action is carried out by pulling the web W through a distance, equivalent to the moving distance of the cross seal jaws 7, in the web transfer direction (See FIG. 8(*a*)).

② The shape of web W taken along the line A—A in FIG. 8(*a*) is as shown in FIG. 8(*b*), and the lug parts of web Wb (see FIG. 11) are folded, as shown in FIG. 8(*c*), from both sides of tubular web W in the right angle direction with respect to the cross seal part Wa (See FIG. 11) formed by the above-mentioned action ①.

The above-mentioned actions ① and ② are basically for applying cross sealing to tubular web W, folding a lug part formed at the cross sealed part and finally forming a hexahedral body. However, by adjusting the folding angle of the lug folding flaps **7*c***, it is possible to adjust the feeding amount of web W.

A predetermined amount of web W is advanced in the above-mentioned action ①, and the usual feeding action and corrective feeding action of web W, which will be described later, are carried out in the above-mentioned action ②.

Figure 6:
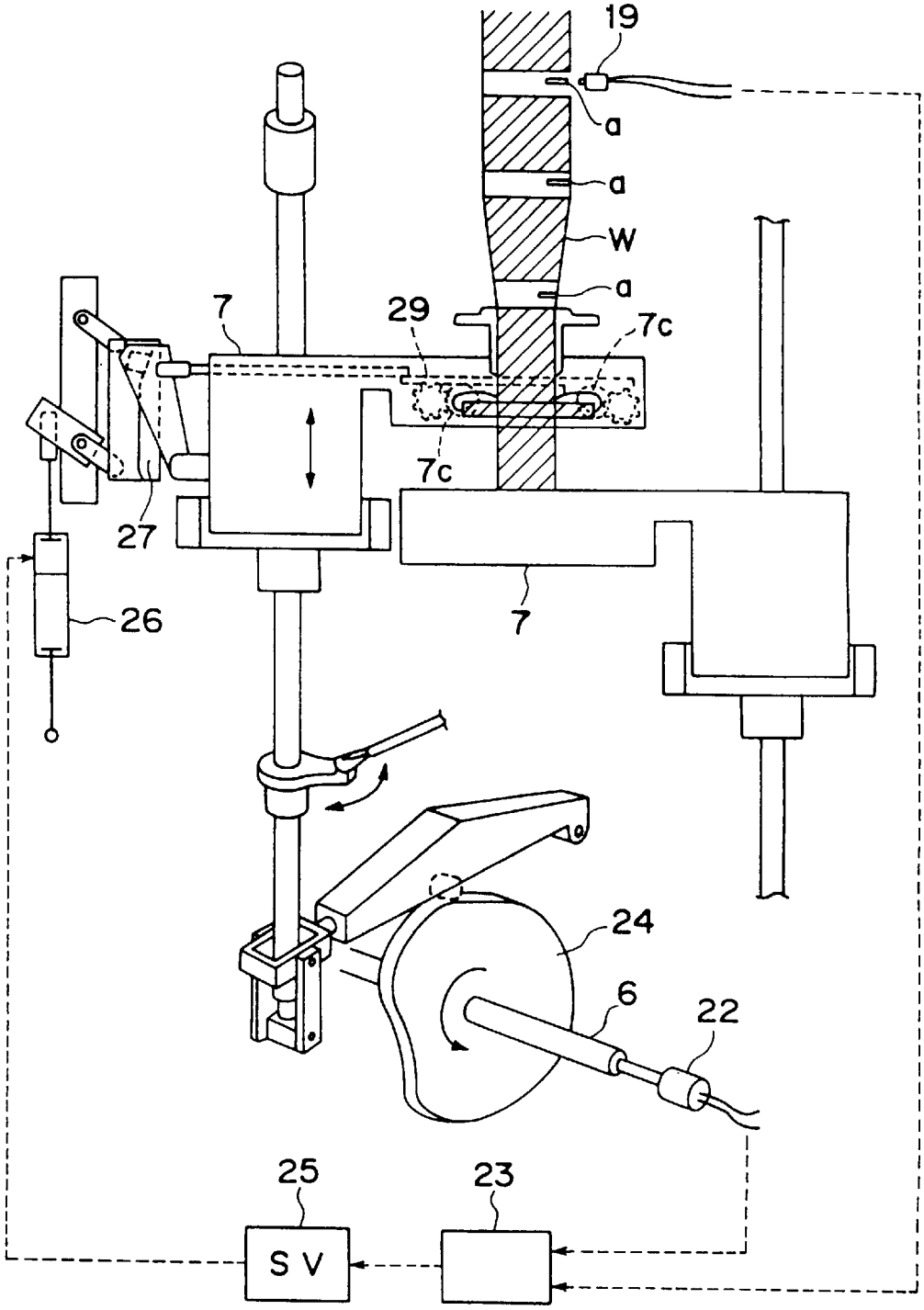
FIG. 6 (PRIOR ART)
FIG. 6 is a view explaining a mechanism of carrying out mark registration of the cross seal jaw of the conventional packaging container producing equipment.

A detector 19 for detection of a mark a such as a specified printing pattern, straw port, etc. is installed, as shown in FIG. 6, at a specified point established in advance on the packaging container producing apparatus. Data signals indicative of detection of a mark a on web W from the above-mentioned detector 19 and cam rotation angle signals from an encoder 22 indicative of the rotational angle of the main shaft 6, to which a cross seal jaw drive cam 24 is attached, are input into a control device 23. The rotational angle of shaft 6 of the cam 24, which is detected at the point in time when the data signal of the above-mentioned detection mark a is read, is regarded as a detection angle of the deviation between the detection mark a in the above-mentioned control device 23, and the detection angle of the above-mentioned detection mark a and the reference angle established in advance. A value corresponding to the deviation is outputted, via a solenoid valve 25, to the pneumatic cylinder 26 for adjusting the folding amount of lug folding flaps 7*c* (FIG. 3) of the cross seal jaws 7.

Figure 7:
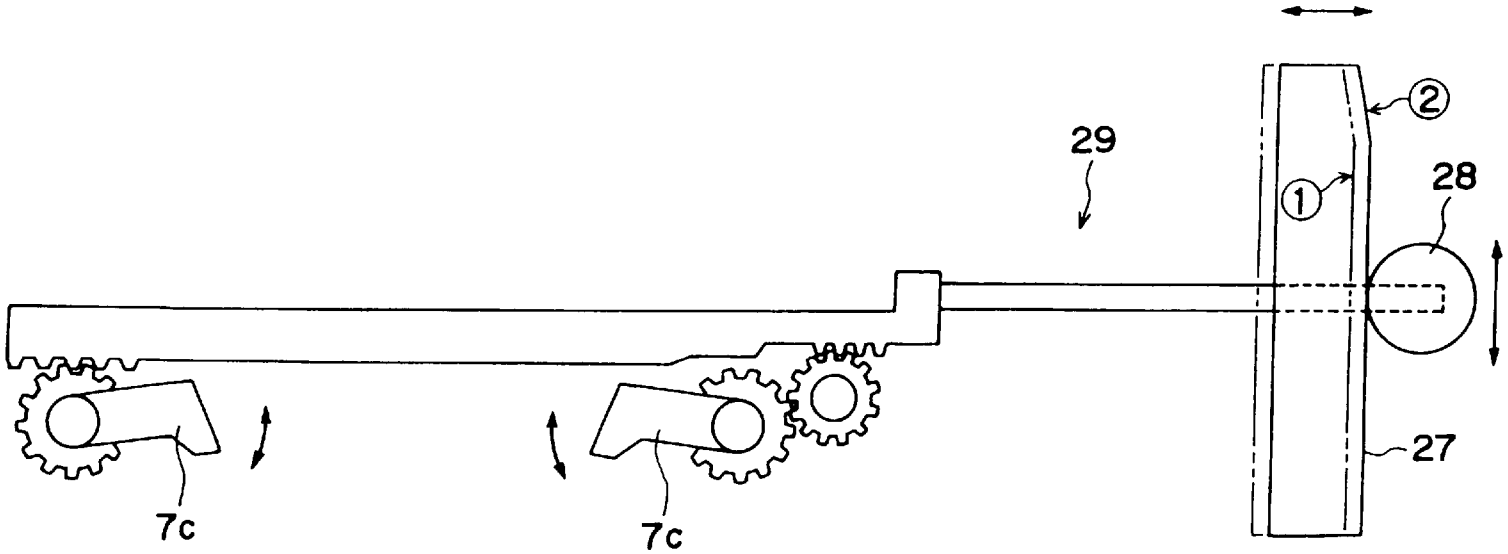
FIG. 7 (PRIOR ART)
FIG. 7 is a view explaining a flap drive section of FIG. 6, FIG. 8 are the cross seal jaw of packaging container producing equipment of FIG. 1.

As shown in FIG. 7, lug folding cam 27 is moved between positions ① and ② in FIG. 5 by the pneumatic cylinder 26. Since a roller 28 moves on the cam surface when the lug folding cam 27 is at the position ①, the lug folding flap 7*c* carries out a corrective action of folding to the position shown in FIG. 9(*b*), and since the roller 28 moves on the cam surface when the lug folding cam 27 is at the position ②, the lug folding flaps 7*c* operate in a normal feeding mode with folding to the position shown in FIG. 9(*a*).

The lug folding angle of web w by the lug folding flaps 7*c* is established in accordance with a deviation between the detection angle of the detection mark a by the detector 19 and the reference angle established in advance, in such a manner that the normal feeding action, which produces a web feeding amount obtained by adding 0.5 mm to the reference feeding amount, is employed until a detection value equivalent to the value obtained by adding 1.5 mm to the reference feeding amount is obtained for the web feeding amount. Further, a value equivalent to the amount obtained by adding 1.5 mm to the reference feeding amount is obtained for the web feeding amount in a corrective feeding action which produces a web feeding amount 1.0 mm less than the reference feeding amount is employed.

FIG. 9(*a*) is a view explaining the normal feeding action and FIG. 9(*b*) is another view explaining a corrective feeding action. In the usual feeding action of web W in FIG. 9(*a*), web W is fed at the initial set value equivalent to the web feeding amount obtained by adding only 0.5 mm to the reference feeding amount (the feeding amount which becomes a reference on design) at a folding angle A° of the lug folding flaps 7*c*.

Web feeding amount in the normal feeding mode =Reference feeding amount+0.5 mm.

Furthermore, the folding angle of the lug folding flaps 7*c* is changed to angle B° in the corrective feeding action of web W shown in FIG. 9(*b*) to advance the web a distance obtained by subtracting only 1.0 mm from the above-mentioned reference feeding amount.

Web feeding amount in the corrective feeding action= Reference feeding amount−1.0 mm The above-mentioned web W feeding amounts [−1.0 mm] or [+0.5 mm] are used for only making the explanation more understandable. That is, the normal feeding action and corrective feeding action of the invention are not limited to these amounts.

Conventionally, the feeding of web W was controlled by only the above-mentioned normal feeding action and corrective feeding action of the lug folding flaps 7*c*. For example, where it is assumed that there is no printing error (no slip of the detection mark a) of web W, and there is nothing abnormal in the feeding amount of the feeding roller 10, guide roller 11, etc., as shown in FIG. 10(*a*), the folding angle of the lug folding flaps 7*c* is maintained at angle B°, as shown in FIG. 9(*b*), and the action is changed to a corrective feeding action after the normal feeding action is performed two times. The web W is fed 0.5 mm in excess of a reference length for each container by the above-mentioned normal feeding (advancing) by the lug folding flaps 7*c* and web W is fed 1.5 mm in excess of the reference feeding amount, which is the allowance for slip, in the corrective feeding.

Web W, the slip of which is returned to 0.5 mm from the reference feeding amount by the corrective feeding action, is then again subject to the normal feeding action. In a case where there is no slip of the detection mark a such as a printing error of web W and there is nothing abnormal in the feeding amount of feeding roller 10, guide roller 11, etc., the above-mentioned corrective feeding amount is carried out once every three feeding actions (see FIG. 10(*a*)).

However, since web W is fed a 0.5 mm excess per normal feeding action, if slip of the detection mark a of web W due to printing error is, for example, +0.5 mm, the slip from the reference feeding amount in total becomes 1.5 mm per normal feeding action, and the feeding is changed to a corrective feeding action after the normal feeding action is performed once. Therefore, the corrective feeding action is executed once every two feeding actions as shown in FIG. 10(*b*). If the control device 23 judges that, in the normal feeding action, slip from the reference feeding amount has become 1.5 mm, the action is changed to the corrective feeding action.

Furthermore, since web W is fed an excess 0.5 mm in the normal feeding action if a slip of the detection mark a of web W is, for example, −0.25 mm each, the mark is separated 0.25 mm from the reference position in each normal feeding action, and at the point of time when the total slip from the reference feeding amount becomes 1.5 mm, the action is changed to a corrective feeding action. Therefore, as shown in FIG. 10(*c*), the corrective feeding action is executed once every five feeding actions.

(2) Method of Adjusting the Degree of Tension Applied to Web W

In order to accurately cause web W to move an appointed distance without fail by the method (1) of adjusting the web feeding amount by adjustment of the folding angle by the lug folding flaps 7*c*, it is necessary to give adequate fixed tension to web W by the tension pressing device 2. For example, if the tension of web W is too much, a mechanical slip occurs between web W and its feeding members, thereby causing the amount of movement of web W to be decreased. On the contrary, if the web tension is too weak, the web is slackened to cause the web W to be transferred beyond that necessary.

In order to give an adequate tension to web W, tension pressing device 2 is composed of a web W feeding roller 10, a guide roller 11*a*, a dancer roller 9 disposed therebetween, a pair of rocking arms 12 carrying the dancer roller 12 at their distal ends for rocking the dancer roller 12, and a rotation shaft 13 to which are attached base ends of the pair of rocking arms 12.

The mark is brought into registration by combining the method (2) and the above-mentioned method (1).

As described above, correction of the amount of feeding is carried out by the lug folding flaps 7*c* for a slight change (for example, 1% of the prescribed value) of the feeding amount of web W. However, it is necessary that a change (error) of the feeding amount of web W, for example, the average error for each 100 pitches of web feeding action, each equivalent to one packaging container C, be less than a predetermined value (for example, ±0.5 mm or less) and a change (error) of the feeding amount of web per pitch of the web feeding action equivalent to one packaging container C not exceed another predetermined value (for example ±1.5 mm).

Furthermore, the more the roll-like web W is consumed, the more frequently the slip of the detection marks exceeds the permissible range of correction of the mark registration, whereby it becomes impossible to correct the feeding amount of web W.

For example, in the three pattern examples shown in FIG. 10(*a*) through FIG. 10(*c*), if slip of the detection mark a from the reference feeding amount, for example due to a printing error, is +1.0 mm per pitch, i.e., per one of the above-mentioned actions, the slip exceeds the allowable range for detection error at once, thereby causing faulty containers C to be produced. In some cases, packaging container producing equipment is unavoidably caused to come to a stop. Furthermore, if slip of the detection mark a is continuous, for example, −0.5 mm or more per pitch, the slip goes beyond the reference feeding amount line (see FIG. 10) equivalent to the reference feeding amount, and correction of the feeding amount of web W becomes impossible.

Furthermore, by repeating the normal feeding action and corrective feeding action which give different folding angles by the lug folding flaps *7c*, packaging containers C of slightly different shape could be produced, e.g., differences in the roundness of lug part Wb of web W, for example a corner is too round or too keen.

As regards packaging containers C formed by the corrective feeding action, since the extent of folding of the lug part Wb is less than the reference value, there is a possibility of producing faulty packaging containers C, that is, faulty products, in which sufficient sealing is not achieved in producing the body portion having a rectangular section, which is carried out in a subsequent process. Furthermore, folding wrinkles may be produced at the corner parts when the final hexahedral body is formed.

Thus, in the prior art, adjustment of the feeding amount of web W while continuously running the machine becomes problematic since the range of adjustment of the feeding amount of web W is narrow.

Therefore, it is an object of the invention to eliminate the deficiencies of the prior art.

It is an object of the invention to quickly eliminate an error of detection mark registration due to printing error, and to provide packaging containers free from any unevenness in shape, for which the range of adjustment of the feeding amount of web W is increased and the adjustment of the feeding amount of web W can be carried out with the machine running.

DISCLOSURE OF THE INVENTION

The above objects are achieved by a packaging container making apparatus of the invention which produces a tubular web from a sheet-like web and forms the tubular web into hexahedral packaging containers. The apparatus of the invention includes a web tension pressing means provided with a rocking arm and a rocking roller secured at the distal end thereof for pressing the sheet-like web; a web tension pressing force setting means for setting the pressing force of said tension pressing means; a sealing member for forming sealed transverse portions of the tubular web by pressing opposing sides of the tubular web while folding both the sides of said tubular web in the direction orthogonal to the lengthwise direction of the tubular web obtained from the sheet-like web, and simultaneously advancing the web a predetermined length (feeding amount); a mark detecting means for detecting presence of specified detection marks or targets on the web at points of detection established in advance; and a web tension pressing force controlling means for step-wise or continuously adjusting the pressing force set by the web tension pressing force setting means to an optimal value, in response to the deviation between a timing when said specified mark detecting means detects a specified detection mark on said web at a specified point, and a reference for the timing for the specified printing detection mark to be detected, which reference timing is established in advance.

Furthermore, the method of the present invention for forming a tubular web from a sheet-like web and producing hexahedral packaging containers comprises the steps of: transferring the sheet-like web while controlling a tension pressing force to an optimal value; forming a tubular web from the sheet-like web being transferred; nipping opposing sides of the tubular web in a direction orthogonal to the length of said tubular web and forming a seal in the tubular web while folding the same and simultaneously advancing the web a predetermined amount; and continuously or step-wise controlling the web tension pressing force to an optimal value in accordance with a deviation between the timing when a specified detection mark on the web is detected at a reference detection point and a reference timing for detection of the specified detection mark at said reference point.

With the packaging container producing equipment of the present invention, the operation amount (folding angle etc.) of a sealing member (for example, lug folding flaps), which forms a seal in the tubular web by pressing opposing sides of the tubular web while folding the same, is set to an a predetermined ideal value in order to secure a prescribed web W feeding amount, thereby causing the tension given to web W being transferred to be controlled. Therefore, in a case where correction is necessary for the web feeding amount, the correction is carried out by controlling the tension operating on the web W while always keeping the operating amount (folding angle) of the sealing member (for example, lug folding flaps) fixed.

As a tension pressing force setting means of the invention, an actuator may be used, which is represented by a pneumatic cylinder or a hydraulic cylinder provided with a pressure change unit, for generating pressure to press the rocking arm in multistage, or an electro-pneumatic proportional valve for stagelessly generating pressure proportionate to electric signals.

According to the invention, it is possible to adjust the feeding amount of web W by controlling a pressing force on web W in the tension pressing device, in accordance with a deviation in registration of a detection mark, such as a specified printing pattern on the printed surface of the web W, from a reference value.

It is preferable that the deviation of the detected value of detection marks, such as a printing pattern on the printed surface on web W, from the reference value be based on the deviation between a set reference value for the angle of rotation or the number of rotations of the main shaft of the packaging container producing equipment and the detected value. This is because the movement of almost all the drive parts of the packaging container producing equipment, such as cross seal jaws, container forming conveyor, etc., depend upon the angle of rotation and the number of rotations of the main shaft. However, instead of depending on the rotational angle or number of rotations of the main shaft, the deviation of the detected value of the above-mentioned specified detection marks from the reference value may be measured on the basis of rotation of other drive components.

In the present invention, the web tension pressing means is provided with a dancer roller rocking in the vertical direction and a web feeding roller which applies a drive force to transport the web W, and the web tension pressing force controlling means is provided with position detecting means for detecting upper limit and lower limit positions of the dancer roller. The rotational speed of the feeding roller is changed between a high-speed set value and a low-speed set value responsive to detection of the feeding roller by detecting the upper limit and lower limit positions of the dancer roller. In this manner, it is possible to further widen the range for adjustment of the web feeding amount.

Thus, with the present invention, the range of correction can be increased relative to the range of correction of the conventional web W feeding amount, and the allowable range for unevenness of detection marks such as a printing error on web W can be also expanded. Therefore, it is possible to operate the machine without stopping, and it is possible to produce packaging containers in which detection marks such as printing patterns can be correctly placed at predetermined locations, thereby avoiding production of faulty products.

BRIEF DESCRIPTION OF THE DRAWINGS

Figure 3A:
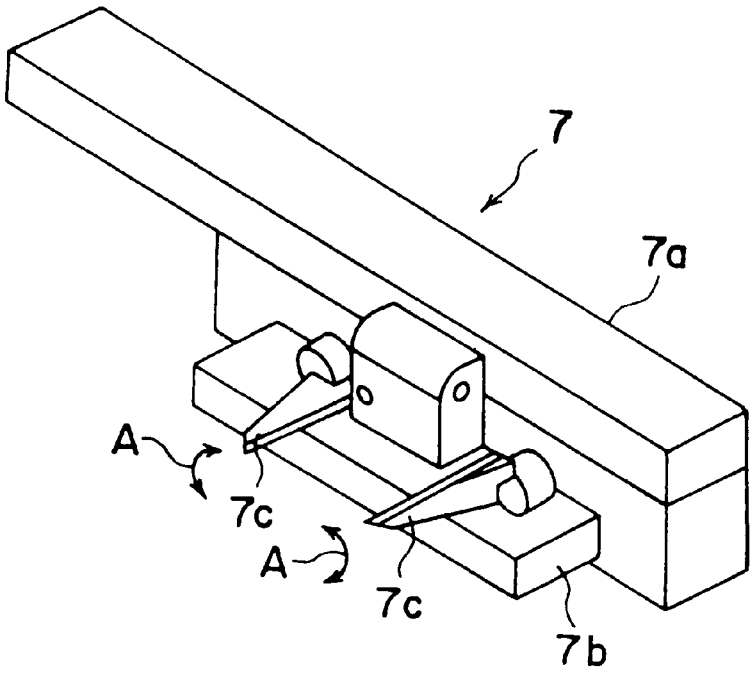
FIG. 3*a* is a perspective view of cross seal jaw.
Figure 3B:
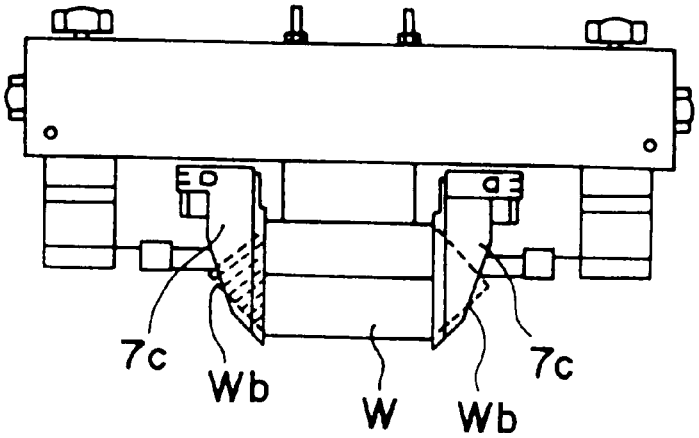
FIG. 3*b* is a top plan view thereof.
Figure 4:
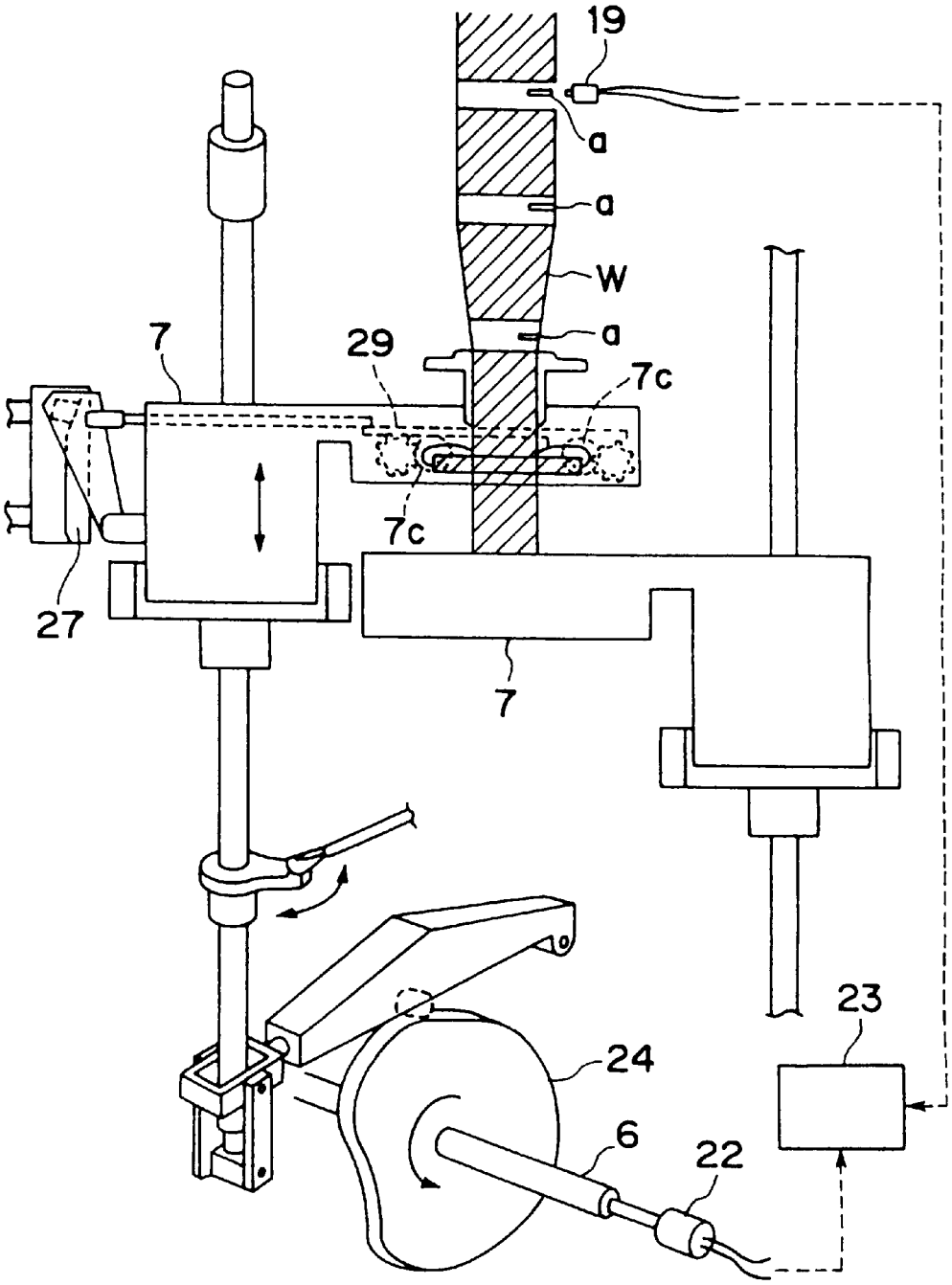
FIG. 4 is a view showing a drive mechanism of flaps, by which the operating amount (feeding amount) of lug folding flaps of packaging container producing equipment of FIG. 1 is kept fixed at all the times.
Figure 8A:
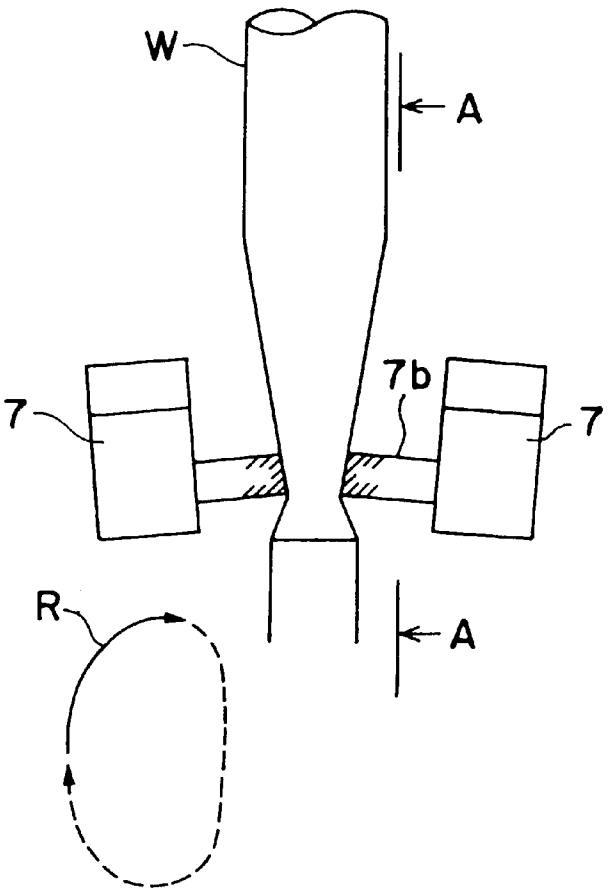
FIG. 8(a) (PRIOR ART)
FIG. 8*a* is an operation view of the cross seal jaw and FIG. 8*b* and FIG. 8*c* are perspective views taken along the line A—A in FIG. 8*a*, and FIG. 9 are the explaining a usual feeding action of the cross seal jaw of the packaging container producing equipment of prior arts.
Figure 8B:
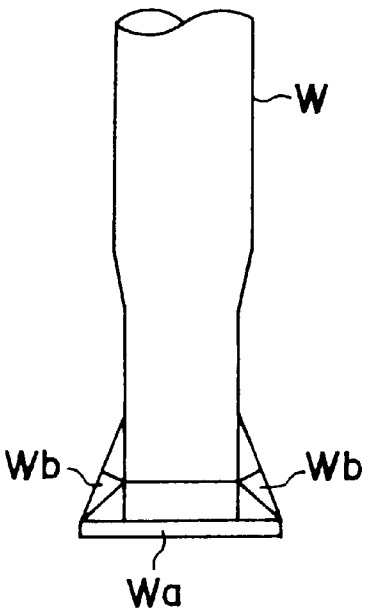
FIG. 8(b) (PRIOR ART)
Figure 8C:
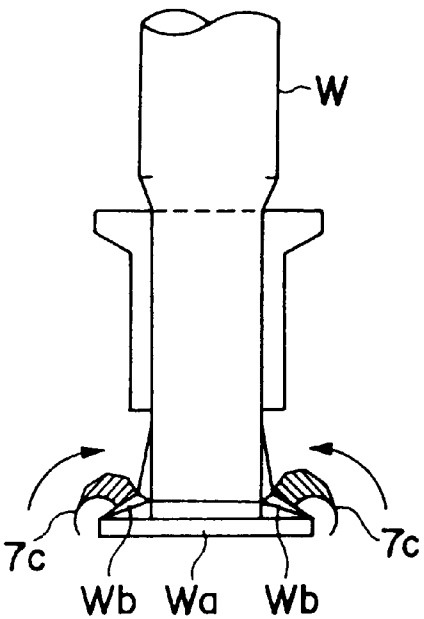
FIG. 8(c) (PRIOR ART)
Figures 9A, 9B:
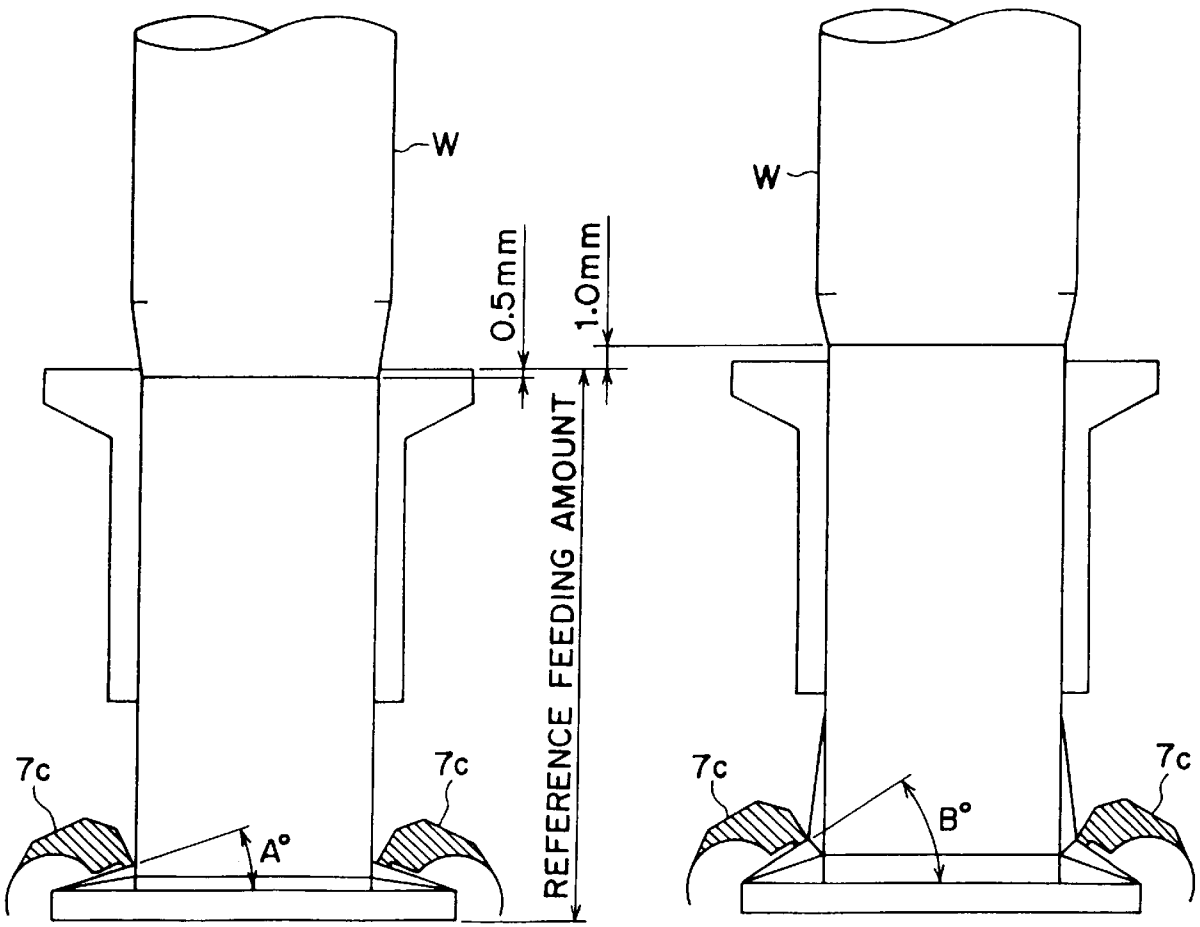
FIG. 9(a) (PRIOR ART)
FIG. 9(b) (PRIOR ART)
FIG. 9*a* is a view explaining a usual feeding action of the cross seal jaw and FIG. 9*b* is also a view explaining a corrective feeding action thereof.
Figures 10A, 10B, 10C:
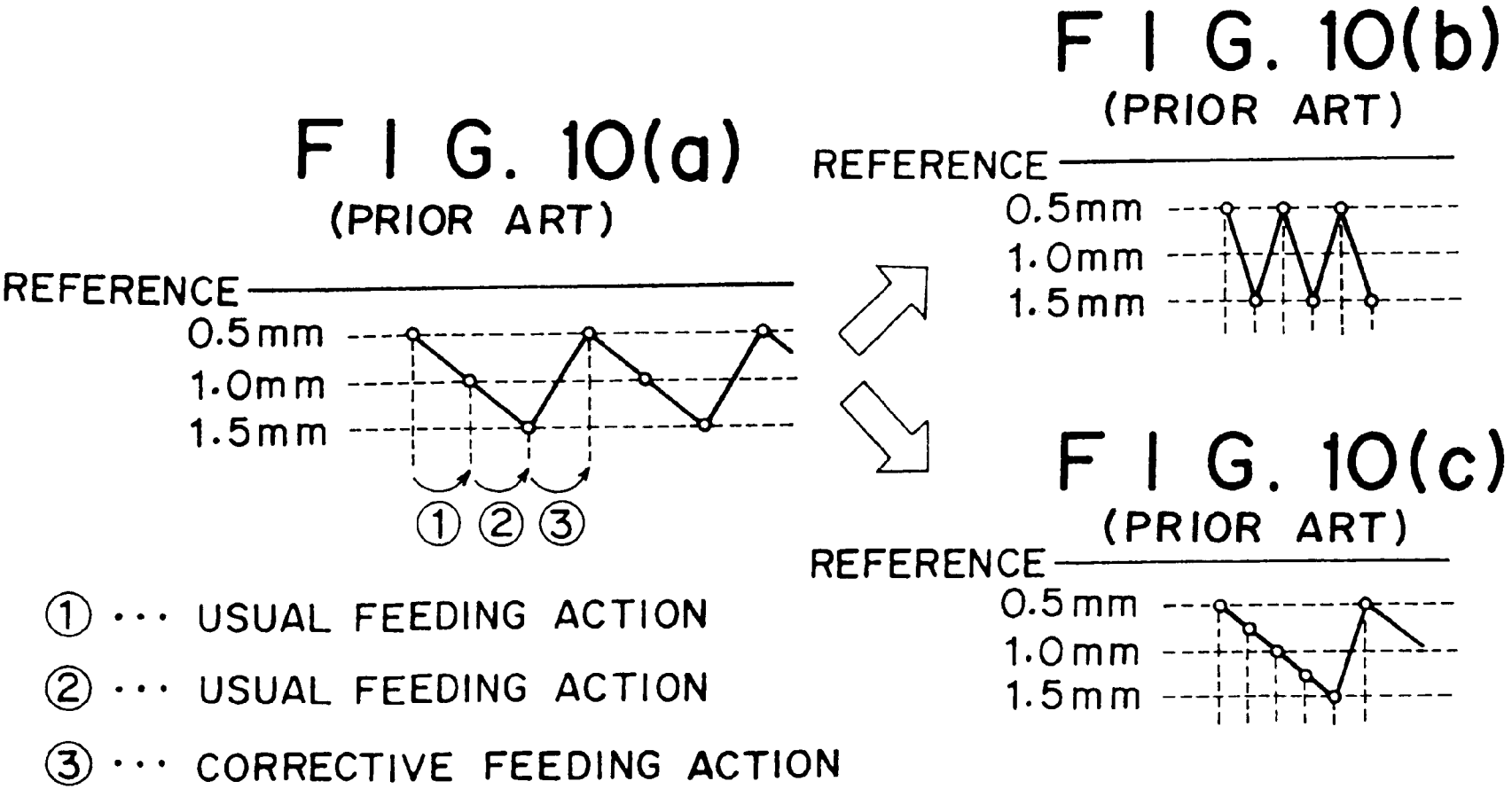
FIG. 10(a) (PRIOR ART)
FIG. 10(b) (PRIOR ART)
FIG. 10(c) (PRIOR ART)
FIG. 10 is a pattern chart of combined movements of the usual feeding action and corrective feeding action in FIG. 9.
Figure 11:
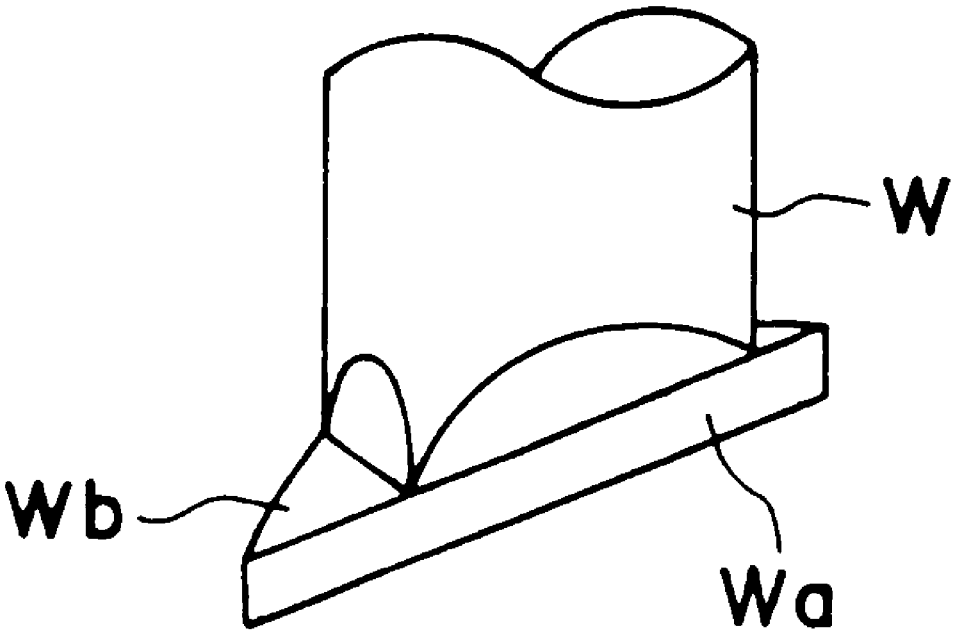
FIG. 11 (PRIOR ART)
FIG. 11 is a perspective view of the cross sealing part of tubular web.

FIG. 1 is a schematic diagram of an apparatus for producing packaging containers, in which a content is filled, from a sheet-like web, according to a preferred embodiment of the invention, FIG. 2 is a rough perspective view of a tension pressing device of the packaging container producing apparatus of FIG. 1, FIG. 3*a* is a perspective view of cross seal jaw, and FIG. 3*b* is a top plan view thereof, FIG. 4 is a schematic view showing a drive mechanism for the flaps, by which the extent of movement of lug folding flaps of packaging container producing apparatus of FIG. 1 is kept fixed at all times, FIG. 5 is a block diagram of a control device for control of a tension pressing force in the apparatus of FIG. 1, FIG. 6 is a view explaining correction of mark registration by the cross seal jaw of the conventional packaging container producing equipment, FIG. 7 is a view explaining a flap drive device in the apparatus of FIG. 6, FIG. 8*a* is a view of the cross seal jaw and FIG. 8*b* and FIG. 8*c* are perspective views taken along the line A—A in FIG. 8*a*, and FIG. 9*a* is a view explaining the normal feeding action of the cross seal jaw and FIG. 9*b* is another view explaining a corrective feeding action thereof, FIGS. 10*a*–10*c* are pattern charts of combined movements of the normal feeding action and corrective feeding action in FIG. 9, FIG. 11 is a perspective view of the cross sealing part of tubular web.

DESCRIPTION OF THE PREFERRED EMBODIMENTS

The packaging container producing apparatus according to a preferred embodiment of the invention is composed of the same construction as the packaging container producing equipment described in FIG. 1. FIG. 2 is a sketch of a device for tensioning the web W being transferred, which is not illustrated in FIG. 1. FIG. 3(*a*) is an enlarged perspective view of web cross seal jaws 7, and FIG. 3(*b*) is a top view thereof. FIG. 4 is a view of a drive mechanism for the lug folding flaps, which keeps the operating amount (folding angle) of the lug folding flaps 7*c* constant.

Herein, members the same as those of the conventional apparatus are given the same reference numbers in describing the apparatus of the invention, and the description thereof is omitted.

In the packaging container producing apparatus of the preferred embodiment of the invention as described above with reference to FIG. 1, the tubular web W is transferred while being pulled by a pair of cross seal jaws 7 moving downward, in the process of pressing the above-mentioned web W in a direction orthogonal to the length of tubular web W by the pair of cross seal jaws 7. At this time, while web Wa (FIG. 11) is being nipped between a pair of jaws 7*b* of the cross seal jaw 7, the lug folding flaps 7*c* fold the lug parts Wb formed at the web W through a predetermined angle.

Therefore, tubular web W is transferred downward and folded while the web W is nipped by a pair of cross seal jaws 7 in the tube forming device 3. However, after the pair of cross seal jaws 7 carry out feeding of web W for an appointed distance while going downward, they return to the higher position.

The tension pressing device 2 controls the feed rate and feeding amount of web W through the packaging container producing apparatus or continuously applies tension to the web W. Formability is worsened and the web feeding amount becomes unstable unless tension is applied to the web when the filled tubular web is formed into a square-column-like web W by forming members (not illustrated).

FIG. 2 is a perspective view of tension pressing device 2. The tension pressing device 2 includes a dancer roller (rocking roller) 9 which is disposed between a feeding roller 10, driven by drive means 8 and having a clutch, and a guide roller 11. The dancer roller 9 is rockable in a direction almost orthogonal to the web transfer direction. Tensioning device 2 further includes a pair of rocking arms 12 which carry the dancer roller 9 at their distal ends and allow the dancer roller 9 to rock; and a rotating shaft 13 secured at the bases of the pair of rocking arms 12, for transmitting a drive force to the rocking arms 12 from a pneumatic cylinder 16 (or a hydraulic cylinder or motor) via member 15.

The pneumatic cylinder 16 is provided with a control valve 31 for stagelessly controlling the air pressure according to an electric current proportional to the deviation between the rotation angle of the main shaft 6 (FIG. 1) and the reference rotation angle. A control valve (not illustrated) which stagelessly controls the air pressure may be provided instead of the control valve 31.

Furthermore, a pressing roller 17 transmits a transfer force to the web W for transport thereof, in cooperation with the feeding roller 10.

As shown in FIG. 2, although the rotating shaft (not illustrated) of the feeding roller 10 and guide roller 11 is supported at the wall of germfree chamber 18, the dancer roller 9 is not supported at said wall. The dancer roller 9 is able to rock in a direction almost orthogonal to the feeding direction of web W supported by the rocking arm 12.

In a preferred embodiment of the invention, in contrast to the prior art described in FIG. 9 and FIG. 10, since the folding angle of the lug folding flap 7*b* (provided at only one cross seal jaw 7 of a pair of cross seal jaws 7 consisting of two sets) of the cross seal jaws 7 is set to an appointed angle, the following method to adjust the tension pressing force on web W exclusively by the web tension pressing device 2 is employed as a method for adjusting the feeding amount of web W to compensate for slip of printing patterns on web W. In this preferred embodiment of the method, the pressing force of the dancer roller 9 on web W is continuously controlled by the tension pressing device 2. As shown in FIG. 2, a pneumatic cylinder 16 for driving the rocking arm rocking shaft 13 is connected to the rocking arm 12 which carries a dancer roller 9 at its distal end. A control valve 31, for example, an electro-pneumatic proportional valve which stagelessly controls the air pressure to pneumatic cylinder 16 responsive to an electric current proportional to the amount of deviation of a detection mark a such as a printing pattern on web W from the above-mentioned reference position. In this manner, the air pressure to the pneumatic cylinder 16 is stagelessly changed, thereby controlling the tension applied onto web W and its feeding.

Alternatively, an air pressure change valve which controls the air pressure in multiple stages may be employed as the control valve 31.

FIG. 5 shows a block diagram of a control device which controls the pressing force of the web tensioning member, e.g., dancer roller 9, utilizing the control valve 31.

A detector 19 for detecting mark a (FIG. 4) on web W is provided in the vicinity of cross seal jaws 7 of tube forming device 3 (FIG. 1), and the main shaft 6 is provided with an encoder 22 (FIG. 1, FIG. 4). As a detection mark a of web W passes at the detector 19, the detection mark a is read by the detector 19. Data read by the detector 19 is inputted into the main shaft rotation angle judging circuit 33 of the control device 23. Furthermore, the rotation angle of the main shaft 6 detected by the encoder 22 is inputted into the main shaft rotation angle judging circuit 33. The main shaft rotation angle judging circuit 33 regards the rotation angle of main shaft 6 as the detected angle at the point in time when data of the detection mark a read by the detector 19 is received. The data of the detector 19 is input into a production control circuit 35 and may be used as data for production control.

The detected angle of the main shaft 6 is input into the subtracter 36 along with the reference angle (rotational angle established as a reference in advance), and subtracter 36 determines any deviation between the detected angle and the reference angle and outputs a deviation value to a corrective value calculation circuit 38. A corrective value for the above-mentioned deviation is obtained by the corrective value calculation circuit 38, and an electric signal corresponding to the calculated corrective value is output from the control device 23 to the control valve 31 of the tension pressing device 2, thereby causing the air pressure to be stagelessly changed, whereby the pressing force on web W is controlled to stagelessly change the feeding amount of web W and an optimal feeding amount of web W is obtained.

Thus, the tension in web W is changed, using the pneumatic cylinder 16 for driving the rocking arm rocking shaft of the tension pressing device 2, and a slip of the detection mark is compensated for. In this manner, it is possible to further widen the correctable range for adjustment of the web W feeding as compared to that of the prior art, notwithstanding that the feed amount of web W by cross seal jaws 7 per container is fixed.

As described above, according to a preferred embodiment of the invention, since the pressing force of web is controlled by the web tension pressing device 2, the allowable range for corrective feeding action of the web W can be further widened as compared to that of the prior art and, even though a change in the web W feeding amount is greater than in the prior art, no faulty product is produced.

In another preferred embodiment, by controlling the pressing force on web by the web tension pressing device 2, it is possible to operate the feeding roller 10 (FIG. 2) at two speeds, high speed and low speed, in addition to adjustment of the web W feeding amount, and tension fluctuation is decreased by securing the amount of accumulation of the web W. Since the web transfer path is long, the path is tortuous with its direction changed many times, and the distance is long, a transfer force of the feeding roller 10 is used in addition to the web transfer force of cross seal jaw 7. However, it is very difficult to make the web feedrate of the web feeding roller 10 completely coincide with the web advancement by the cross seal jaw 7. Therefore, in order that the tension or feedrate of web at the tension pressing device 2 including the feeding roller 10 does not influence the web feedrate at the cross seal jaw 7, it is necessary to provide an amount of web length accumulation by the tension pressing device 2, consisting of web feeding roller 10, etc., which corresponds to the feedrate of web W due to the action of the cross seal jaw 7.

Therefore, a rocking type dancer roller 9 is provided to allow the feeding roller 10 to be changed between high-speed operation and low-speed operation. Thereby, the tension applied onto web W can be controlled and kept constant.

When the feeding roller 10 is operated at a low speed, the dancer roller 9 is slowly elevated, and when the dancer roller 9 reaches the upper dead point, the feeding roller 10 is changed to a high-speed operation to cause the accumulated amount of web to be increased. The dancer roller 9 is then slowly lowered and when the dancer roller reaches the lower dead point, it is changed to a low-speed operation again to cause the feeding amount (feedrate) of web W per unit time to decrease. Then, the dancer roller 9 is elevated whereby the tension of the web W is controlled and kept constant.

With reference to FIG. 2, control to keep the tension of web W constant is achieved by changing the feeding roller 10 between high-speed and low-speed operation. The feeding roller 10 is driven by a drive means 8 having a clutch, to impart a transfer force for web W while the web W is being nipped between the feeding roller 10 and pressing roller 17. The pressing roller 17 is able to give a pressing force to the feeding roller 10 by using a fluid cylinder (not illustrated). Furthermore, rotation shaft 13 of the rocking arm 12 of the dancer roller 9 penetrates the wall of the germfree chamber 18 and an operating arm 20 is fixed to shaft 13 outside the wall of the chamber. The operating arm 20 is elongated in a direction parallel to the rocking arm 12. The upper-limit position detector **21*a* and lower-limit position detector 21*b* are respectively provided at the outer side of the germfree chamber in the vicinity of the operating area of the tip end of the operating arm 20**.

Although the driving means 8 of the feeding roller 10 is operable at two stages, high speed and low speed, web W is intermittently fed in the process of forming it from tubular web W into hexahedral packaging containers C (FIG. 1). If it is assumed that it is continuously advanced, the feeding amount per unit time is made a reference feeding amount. In this case, the operating speed of the driving means 8 is established so that the feeding amount of web W by the feeding roller 10 exceeds the reference feeding amount when the driving means 8 is operated at the high speed, and the feeding amount of web W by the feeding roller 10 becomes less than the reference feeding amount when the driving means 8 is operated at a low speed.

Since the feeding amount of web W by the feeding roller exceeds the reference feeding amount if it is assumed that the driving means 8 is operated at the high speed, the web W is slackened, and the slackening thereof is gradually increased, and the dancer roller 9 is caused to go down by a pressing force of the pneumatic cylinder 16.

Therefore, the rocking arm 12 rotates downward through an arc centered on its rotational shaft 13, and the operating arm 20 rotates in the same direction as that of the rocking arm 12 via its rotational shaft 13. In the meantime, as the tip end part of the operating arm 20 reaches the position opposite the lower limit position detector **21*b* it is detected by detector 21*b*. At this time, detector 21*b* outputs a lower limit position signal, and the control device 23 changes the high speed operation of the driving means 8** to the lower speed operation responsive to that signal.

Since the feeding amount of web W by the feeding roller 10 becomes less than the reference feeding amount at this time, the slackening of web W is gradually decreased, and the dancer roller 9 is elevated by being pulled by the web W. At this time, the operating arm 20 rotates in the reverse of the above-mentioned direction, and as its distal end comes to the position opposite the upper limit position detector 21*a*, the detector 21*a* outputs an upper limit position signal, whereby the driving means 8 is changed from the low speed operation to the high speed operation.

Thus, although the dancer roller 9 repeats vertical movements between that the upper limit position and lower limit position where detectors 21*a*, 21*b* detect the operating arm 20, web W is given a tension by the pressing force from the pneumatic cylinder of the dancer roller 9, whereby the web W is continuously advanced. Therefore, it is possible to keep the tension, applied onto the web W, fixed at all the times. Furthermore, since the upper limit and lower limit detectors 21*a*, 21*b* are disposed outside the germfree chamber 18, the possibility of faults in the upper and lower limit position detectors 21*a*, 21*b*, resulting from high temperature inside the germfree chamber 18, is eliminated.

As described above, according to the invention, the allowable range for the corrective action of web feeding amount by the cross seal jaws 7 is wider than in the prior art because of controlling the web tension pressing force, and if a change (error) of the feeding amount of web W is greater than normal, no faulty products need be produced.

What is claimed is:

1. An apparatus for making a packaging container from a sheet-like web comprising:

a web feeding roller for transporting the sheet-like web along a feed path in a direction lengthwise of the sheet-like web, said web feeding roller having at least two modes of operation including a high-speed mode and a low-speed mode, said web feeding roller transporting said sheet-like web at first rate in its high-speed mode and transporting said sheet-like web at a second rate, lower than said first rate, in its low-speed mode;

a web tensioning device including a pivotally mounted rocking arm and a dancer roller rotatably secured at a distal end of said rocking arm, said dancer roller applying a pressing force against the sheet-like web while said web tensioning device pivots between upper limit and lower limit positions;

detection means for detecting the presence of said web tensioning device at said upper limit and said lower limit positions;

web feed rate control means for switching operation of said web feeding roller between said high speed and low speed modes responsive to detection of said web tensioning device at said upper limit and lower limit positions;

tube forming means for forming the sheet-like web into a tubular web;

sealing means for sealing portions of the tubular web by pressing together opposing sides of the tubular web, said sealed portions of said tubular web extending in a direction orthogonal to the lengthwise direction of the tubular web;

mark detecting means for detecting registration and timing of predetermined detection marks on the web with points of detection established in advance;

a drive cylinder connected to said rocking arm for setting the pressing force applied by said tensioning device; and web tension control means for controlling said drive cylinder to change the value for pressing force set by said drive cylinder responsive to variation in the timing of the detected registration.

2. An apparatus for forming a packaging container in accordance with claim 1 wherein said drive cylinder is a fluid-actuated cylinder connected to said rocking arm and wherein said web tension control means changes fluid pressure fed to said fluid-actuated cylinder responsive to the variation in timing of the detected registration.

3. A method for forming a packaging container from a sheet-like web comprising:

transporting the sheet-like web along a feed path in a high speed mode or a low speed mode, said high speed mode transporting said sheet-like web at a first rate and said low speed mode transporting said sheet-like web at a second rate, lower than said first rate;

tensioning said sheet-like web, by applying a pressing force against said sheet-like web with a tensioning member which moves between an upper limit position and a lower limit position;

detecting the presence of said tensioning member at said lower limit position and at said upper limit position and switching between said high speed mode and said low speed mode in accordance with said detection;

forming said sheet-like web into a tubular web;

gripping opposing sides of the tubular web to press said opposing sides together along a transverse section of said tubular web extending in a direction orthogonal to the lengthwise direction and sealing said transverse section;

pulling the gripped web to advance the tubular web a predetermined distance, detecting registration and timing of predetermined detection marks on the web with points of detection established in advance; and controlling the pressing force of the web tensioning member responsive to variation in the timing of the detected registration.

* * * * *